US006773475B2

(12) United States Patent
Ohishi

(10) Patent No.: US 6,773,475 B2
(45) Date of Patent: Aug. 10, 2004

(54) ABRASIVE MATERIAL HAVING ABRASIVE LAYER OF THREE-DIMENSIONAL STRUCTURE

(75) Inventor: Michihiro Ohishi, Sagamihara (JP)

(73) Assignee: 3M Innovative Properties Company, Saint Paul, MN (US)

( * ) Notice: Subject to any disclaimer, the term of this patent is extended or adjusted under 35 U.S.C. 154(b) by 23 days.

(21) Appl. No.: 10/168,455

(22) PCT Filed: Dec. 21, 2000

(86) PCT No.: PCT/US00/35355

§ 371 (c)(1),
(2), (4) Date: Sep. 11, 2002

(87) PCT Pub. No.: WO01/45903

PCT Pub. Date: Jun. 28, 2001

(65) Prior Publication Data

US 2004/0031205 A1 Feb. 19, 2004

(30) Foreign Application Priority Data

Dec. 21, 1999 (JP) ..... 11-362837

(51) Int. Cl.[7] ..... B24D 3/00; B24D 3/28; B24D 11/00; B24D 18/00

(52) U.S. Cl. ..... 51/298; 51/307; 51/308; 51/309; 51/295; 51/297; 51/293; 451/28

(58) Field of Search ..... 51/298, 307, 308, 51/309, 297, 295, 293; 451/28

(56) References Cited

U.S. PATENT DOCUMENTS

| | | | | |
|---|---|---|---|---|
| 5,014,468 A | | 5/1991 | Ravipati et al. | |
| 5,147,416 A | | 9/1992 | Ohishi | |
| 5,152,917 A | | 10/1992 | Pieper et al. | |
| 5,199,227 A | | 4/1993 | Ohishi | |
| 5,304,223 A | | 4/1994 | Pieper et al. | |
| 5,679,067 A | * | 10/1997 | Johnson et al. | 451/527 |
| 6,179,887 B1 | * | 1/2001 | Barber, Jr. | 51/298 |

FOREIGN PATENT DOCUMENTS

| | | |
|---|---|---|
| EP | 0 664 187 A1 | 7/1995 |
| JP | 9-057632 | 3/1997 |
| JP | 9-248771 | 9/1997 |
| WO | WO 92/13680 | 8/1992 |
| WO | WO 96/27189 | 9/1996 |
| WO | WO 99/59778 | 11/1999 |
| WO | WO 00/13853 | 3/2000 |

* cited by examiner

*Primary Examiner*—Michael Marcheschi
(74) *Attorney, Agent, or Firm*—Gary L. Griswold; Colene H. Blank; Daniel D. Biesterveld

(57) ABSTRACT

To provide an abrasive material which is excellent in loading resistance and durability, allows no attachments to attach to an abraded surface even when the end surface of the optical fiber is abraded, and is particularly suited for use in abrading a hard material such as an end surface of an optical fiber connector effectively and smoothly into a predetermined shape. The present invention provides an abrasive material for abrading an end surface of an optical fiber connector into a predetermined shape, the abrasive material having a base material (101) and an abrasive layer (102) disposed on the base material, the abrasive layer having a top layer (105) comprising an abrasive composite containing abrasive grains and a binder and a foot portion (106) comprising a binder in the absence of abrasive particles, the abrasive layer having a three-dimensional structure constructed with a plurality of regularly arranged three-dimensional elements (104) having a predetermined shape. Further, the present invention provides a method for producing an abrasive material having an abrasive layer of a three-dimensional structure, the method comprising the steps of: (1) filling a mold sheet having a plurality of regularly arranged recesses, with an abrasive material coating solution containing abrasive grains, a binder, a solvent, to a predetermined depth; (2) removing the solvent from the abrasive material coating solution in the recesses by evaporation; (3) filling the recesses further with a binder; (4) laminating a base material on the mold sheet to bond the binder to the base material; and (5) hardening the binder.

24 Claims, 22 Drawing Sheets x50 x10 x50 x10 x50 x10 x50 x50 x50 x10 x50 x10 x50 x10

ABRASIVE MATERIAL HAVING ABRASIVE LAYER OF THREE-DIMENSIONAL STRUCTURE

FIELD OF THE INVENTION

The present invention relates to an abrasive material having an abrasive layer of a three-dimensional structure, and more particularly to an abrasive material having an abrasive layer of a three-dimensional structure and being suited for abrading an end surface of an optical fiber on which a ferrule is mounted, i.e., an end surface of an optical fiber connector, into a predetermined shape.

BACKGROUND OF THE INVENTION

Conventionally, an optical fiber connector which can be easily removed is widely used for connection of optical fibers in an optical fiber communication network. In the connection at the optical fiber connector, end surfaces of the optical fiber ferrules made of an optical fiber and a covering portion (ferrule) for covering the optical fiber are allowed to directly abut each other. Therefore, the optical characteristics at the time of connection, particularly the connection loss, depend on the processing properties and precision of the end surfaces of the optical fibers.

The end surface of the optical fiber ferrule is processed through a number of abrasion steps. The quality of the end surface is influenced by the processing properties and the precision in the final finishing abrasion step. In other words, the major factors for the connection loss of the optical fiber are the degree of finishing roughness of the end surface and its inclination.

With respect to the finishing roughness of an end surface of an optical fiber ferrule, correlation with the particle size of an abrasive material used for the abrasion is reported. For example, in the case of a step index type fiber, the connection loss is about 0.5 dB if the particle size of the abrasive grains is about 1 $\mu$m whereas the connection loss is more than about 1.0 dB if the particle size of the abrasive grains is about 15 $\mu$m.

Upon observation of this correlation, it will be under stood that abrasive grains having a particle size of 10 to 15 $\mu$m must be used in order to satisfy a standard requiring the connection loss of the optical fiber to be less than 1 dB, and fine grade abrasive grains having a particle size of less than 1 $\mu$m must be used in order to satisfy a standard requiring the connection loss of the optical fiber to be less than 0.5 dB.

Japanese Laid-open Patent Publication No. 09-248771/1997 discloses an abrasive tape for an end surface of an optical fiber connector in which the abrasive tape has a base material and an abrasive layer disposed on the base material, the abrasive layer is composed of silica particles having an average particle size of 5 to 30 $\mu$m and has a binder for connecting these abrasive material particles, and the central line average roughness Ra of the abrasive layer surface is 0.005 to 0.2 $\mu$m.

Fine grade abrasive materials such as an abrasive tape for an end surface of an optical fiber connector have a problem of loading. The term "loading" means that the space among abrasive grains is filled with abrasion dusts that protrude to inhibit the abrasive property. For example, in the case where an end surface of an optical fiber connector is abraded, the particles of abrasion dusts stay in the space among the abrasive grains, whereby the cutting ability of the abrasive grains decreases. Further, liquid that is used as a coolant and a lubricant does not act sufficiently between the abrasive material and the end surface of the optical fiber connector, whereby a part of the abrasive layer adheres to the surface of the optical fiber connector after abrasion and its removal is cumbersome.

Moreover, if fine particles are used as the abrasive grains, the period of time required for abrasion will be long. On the other hand, if the particle size of the abrasive grains is increased, the finished end surface of the optical fiber connector will be rough, thereby failing to meet the standard for connection loss of the optical fiber. If both methods are used in combination, the number of abrading steps will increase.

WO92/13680 and WO96/27189 disclose an abrasive material having an abrasive layer of a three-dimensional structure. This abrasive material has a base material and an abrasive layer disposed on the base material, the abrasive layer is made of an abrasive composite containing abrasive particles and a binder, and the abrasive layer has a three-dimensional structure constructed with a plurality of regularly arranged three-dimensional elements having a predetermined shape. As the shape of the three-dimensional elements, tetrahedral shape, pyramidal shape, and others are disclosed.

This abrasive material is resistant to loading and excellent in durability. However, since the abrasive grains are uniformly dispersed all over in the abrasive layer and the abrasive grains located on the lower part of the abrasive layer do not act effectively, the production cost is high.

Further, an abrasive material having such an abrasive layer of a three-dimensional structure is produced by applying an abrasive slurry containing abrasive particles and a binder in a mold sheet having a structure, superposing a base material on the mold sheet to bond the binder to the base material, hardening the binder by ultraviolet radiation, and removing the mold sheet. In this case, the abrasive slurry must have a sufficient fluidity to be introduced into the structure within the mold sheet. Further, since the ultraviolet radiation is performed after covering the abrasive slurry with the base material, the abrasive slurry must not contain a volatile component.

Therefore, the content of the abrasive grains in the abrasive slurry cannot exceed the critical pigment volume concentration. Accordingly, the conventional abrasive material having an abrasive layer of a three-dimensional structure has a problem that the content of abrasive grains in the abrasive layer cannot be sufficiently raised.

By comparison under abrasive conditions in which the particle size of abrasive grains, the abrasive means, and others are the same, the abrasive property of the abrasive material will decrease as the content of the abrasive grains is reduced. Particularly, in fine grade abrasive materials, the abrasive efficiency will be poor to increase the period of time required for abrasion if the content of the abrasive grains is insufficient.

Accordingly, since the content of the abrasive grains is insufficient, the conventional abrasive material having an abrasive layer of a three-dimensional structure is poor in abrasive property and hence is not suited for abrading a hard material such as an end surface of an optical fiber connector efficiently and smoothly into a predetermined shape.

The present invention has been made to solve the aforesaid problems of the prior art and an object thereof is to provide an abrasive material which is excellent in loading resistance and durability, allows no attachments to attach to an abraded surface even when the end surface of the optical fiber is abraded, and is particularly suited for use in abrading a hard material such as an end surface of an optical fiber connector effectively and smoothly into a predetermined shape.

SUMMARY OF THE INVENTION

The present invention provides an abrasive material for abrading an end surface of an optical fiber connector into a predetermined shape, the abrasive material having a base material and an abrasive layer disposed on the base material, the three dimensional elements having (1) top layer comprising an abrasive composite comprising abrasive grains dispersed within a binder and (2) a foot portion comprising a binder in the absence of abrasive particles, the abrasive layer having a three-dimensional structure constructed with a plurality of regularly arranged three-dimensional elements having a predetermined shape, thereby to achieve the aforesaid object of the present invention.

Further, the present invention provides a method for producing an abrasive material having an abrasive layer of a three-dimensional structure, the method comprising the steps of: (1) filling a mold sheet having a plurality of regularly arranged recesses, with an abrasive material coating solution containing abrasive grains, a binder, and a solvent, to a predetermined depth; (2) removing the solvent from the abrasive material coating solution in the recesses by evaporation; (3) filling the recesses further with a binder in the absence of abrasive particles; (4) laminating a bass material on the mold shoot to bond the binder to the base material; and (5) hardening the binder.

The abrasive material having an abrasive layer of a three-dimensional structure is preferably produced by the aforesaid production method.

BRIEF DESCRIPTION OF THE DRAWINGS

The above and further objects and features of the invention will more fully be apparent from the following detailed description with accompanying drawings, in which.

DETAILED DESCRIPTION OF THE INVENTION

Figure 1:
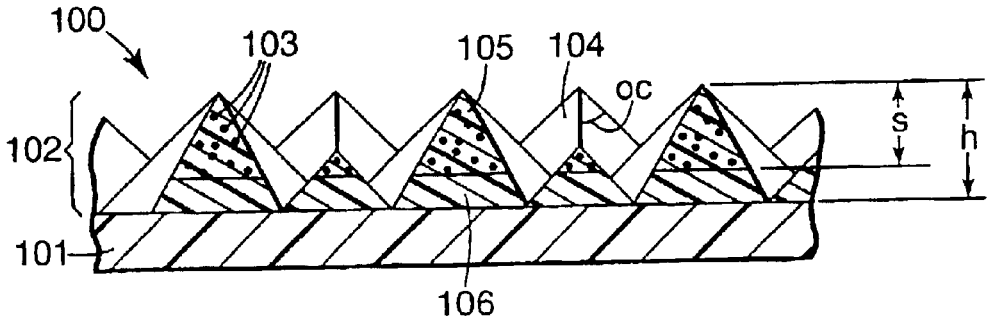
FIG. 1 is a section view illustrating an abrasive material having an abrasive layer of a three-dimensional structure according to an embodiment of the present invention.

FIG. 1 is a section view illustrating an abrasive material having an abrasive layer of a three-dimensional structure as an embodiment of the present invention. An abrasive material 100 has a base material 101 and an abrasive layer 102 disposed on a surface of the base material 101.

Preferable examples of the base material for the present invention include polymer film, paper, cloth, metal film, vulcanized fiber, non-woven base material, a combination thereof, and a processed product thereof. In the case of spherically abrading the end surface of the optical fiber connector, the base material is preferably flexible, thereby facilitating formation of a spherical shape. The base material is preferably transparent with respect to ultraviolet radiation, since it is convenient in the production process.

The base material may be, for example, a polymer film such as polyester film. The polymer film may be undercoated with a material such as polyethylene acrylic acid in order to promote bonding to the base material of the abrasive composite.

The abrasive layer 102 has an abrasive composite containing a matrix of a binder and abrasive grains 103 dispersed therein as construction components.

The abrasive composite is formed from a slurry containing a plurality of abrasive grains dispersed in the binder which is in an unhardened or ungelated state. In hardening or gelation, the abrasive composite is solidified, i.e. is fixed to have a predetermined shape and a predetermined structure.

The dimension of the abrasive grains may vary depending on the type of the abrasive grains or the intended use of the abrasive material. For example, the dimension is 0.01 to 1 μm, preferably 0.01 to 0.5 μm, more preferably 0.01 to 0.1 μm for the final finishing abrasion, and is 0.5 to 20 μm, preferably 0.5 to 10 μm for rough abrasion in forming a curved surface. Preferable examples of the abrasive grains for the present invention include diamond, cubic boron nitride, cerium oxide, fused aluminum oxide, heat-treated aluminum oxide, sol-gel aluminum oxide, silicon carbide, chromium oxide, silica, zirconia, alumina zirconia, iron oxide, garnet, and a mixture thereof. Especially preferable ones are diamond, cubic boron nitride, aluminum oxide, and silicon carbide for the rough abrasion, and silica and aluminum oxide for the finishing abrasion.

The binder is hardened or gelated to form an abrasive layer. Preferable examples of the binder include phenolic resin, resol-phenolic resin, aminoplast resin, urethane resin, epoxy resin, acrylate resin, polyester resin, vinyl resin, melamine resin, acrylated isocyanurate resin, urea-formaldehyde resin, isocyanurate resin, acrylated urethane resin, acrylated epoxy resin, and a mixture thereof. The binder may be a thermoplastic resin. Especially preferable examples of the binder include phenolic resin resol-phenolic resin, epoxy resin, and urethane resin.

The binder may be radiation-curing. The radiation-curing binder is a binder that is at least partially hardened or is at least partially polymerizable by radiation energy. Depending on the binder to be used, an energy source such as heat, infrared radiation, electron beam radiation, ultraviolet radiation, or a visible light radiation is used.

Typically, these binders are polymerized by a free radical mechanism. Preferably, these binders are selected from the group consisting of acrylated urethane, acrylated epoxy, an aminoplast derivative having an α, β unsaturated carbonyl group, an ethylenic unsaturated compound, an isocyanurate derivative having at least one acrylate group, isocyanate having at least one acrylate group, and a mixture thereof.

If the binder is hardened by ultraviolet radiation, a photoinitiator is required to start free radical polymerization. Preferable examples of the photoinitiator to be used for this purpose include organic peroxides, azo compounds, quinones, benzophenones, nitroso compounds, acryl halides, hydrazones, mercapto compounds, pyrylium compounds, triacrylimidazole, bisimidazole, chloroalkyltriazine, benzoin ether, benzyl ketal, thioxanthone, and acetophenone derivatives. A preferable photoinitiator is 2,2-dimethoxy-1, 2-diphenyl-1-ethanone.

If the binder is hardened by visible light radiation, it is necessary that a photoinitiator stakrts a free radical polymerization. Preferable examples of the photoinitiator for this purpose are disclosed in U.S. Pat. No. 4,735,632, column 3, line 25 to column 4, line 10, column 5, lines 1 to 7, and column 6 lines 1 to 35, which are incorporated herein by reference.

The weight proportion of the abrasive grains to the binder is typically within a range of about 1.5 to 10 parts of abrasive grains with respect to one part of the binder, preferably about 2 to 7 parts by weight of abrasive grains with respect to one part of the binder. This proportion may vary depending on the size of the abrasive grains, the type of the binder to be used, and the intended purpose of the abrasive material.

In smoothly and finely abrading a hard material such as an end surface of an optical fiber connector, the concentration of the abrasive grains contained in the abrasive composite is preferably within a range of 43 to 90 wt % if the abrasive grains are made of silicon carbide; 70 to 90 wt % if the abrasive grains are made of spherical abrasive particles of alumina, silica, or the like; 37 to 90 wt % if the abrasive grains are made of alumina; and 39 to 90 wt % if the abrasive grains are made of diamond.

The abrasive composite may contain a material other than the abrasive grains and the binder. For example, the abrasive material may contain ordinary additives such as a coupling agent, a lubricant, a dye, a pigment, a plasticizer, a filler, a stripping agent, an abrasive aid, and a mixture thereof.

The abrasive composite can contain a coupling agent. Addition of the coupling agent can considerably reduce the covering viscosity of a slurry to be used for formation of the abrasive composite. Preferable examples of the coupling agent for the present invention include organic silane, zircoaluminate, and titanate. The amount of the coupling agent is typically less than 5 wt %, preferably less than 1 wt %, of the binder.

The abrasive layer 102 has a three-dimensional structure constructed with a plurality of regularly arranged three-dimensional elements 104 having a predetermined shape. The three-dimensional elements 104 each have a tetrahedral shape in which ridges are connected at a point on the top. In this case, the angle α formed between two ridges is typically 30 to 150°, preferably 45 to 140°. The three-dimensional elements 104 may have a pyramidal shape. In this case, the angle α formed between two ridges is typically 30 to 150°, preferably 45 to 140°.

The points on the top of the three-dimensional elements 104 are located on a plane parallel to the surface of the base material substantially over an entire region of the abrasive material. In FIG. 1, the symbol h represents the height of the three-dimensional elements 104 from the surface of the base material. The height h is typically 2 to 300 μm, preferably 5 to 150 μm. The variation of the height of the points on the top is preferably less than 20%, more preferably less than 10%, of the height of the three-dimensional elements.

The three-dimensional elements 104 are arranged in a predetermined configuration. In FIG. 1, the three-dimensional elements 104 are most closely packed. Typically the three-dimensional elements are repeated with a predetermined period. This repetitive shape is one-directional or preferably two-directional.

The abrasive grains do not protrude beyond the surface of the shape of the three-dimensional elements. In other words, the three-dimensional elements 104 are constructed with flat planes. For example, the surfaces constituting the three-dimensional elements 104 have a surface roughness Ra of less than 2 μm, preferably less than 1 μm.

In the three-dimensional element 104, its top portion 105 performs an abrading function. While the abrasive material is subjected to abrasion, the three-dimensional elements are decomposed starting from the top portion, thereby allowing unused abrasive grains to appear. Therefore, in order to increase the abrasive property of the abrasive material, the concentration of the abrasive grains in the abrasive composite located in the top portion of the three-dimensional element is preferably increased to be as high as possible so that the abrasive material may have a higher abrasive property to be suited for abrading a hard material. The concentration of the abrasive grains in the abrasive composite located in the top portion of the three-dimensional element more preferably exceeds the critical pigment volume concentration.

Generally, the critical pigment volume concentration is considered to be the pigment volume concentration where there is just sufficient binder to coat pigment surfaces and provide a continuous phase throughout the film. The critical pigment volume concentration as used herein means a volume concentration of abrasive grains when the gaps among the grains are just filled with a binder. In the case where the binder is liquid, the mixture has fluidity if the concentration is less than the critical pigment volume concentration, whereas the mixture loses its fluidity if the concentration exceeds the critical pigment volume concentration. If the concentration of the abrasive grains in the abrasive composite located in the top portion of the three-dimensional element is less than or equal to the critical pigment volume concentration, the abrasive property of the abrasive material will be insufficient, so that the abrasive material will not be suitable for abrasion of a hard material such as an end surface of an optical fiber connector.

The foot portion 106 of the three-dimensional element, namely the lower portion of the abrasive layer adhering to the base material, does not usually perform an abrading function. This is because, if the abrasive layer is worn to the lower portion, the abrasive material is usually discarded. The foot portion 106 of the three-dimensional element that does not perform the abrading function need not contain abrasive grains, so that the foot portion 106 may be made of the binder alone.

By allowing the three-dimensional element 104 to have such a two-layer structure, the amount of the comparatively expensive abrasive grains can be saved, whereby the abrasive material can be provided at a lower cost. In addition, since the binder in the foot portion 106 can be designed considering only the adhesive power of the binder to the base material, poor adhesion to the base material hardly occurs.

In FIG. 1, the symbol s represents the height of the top portion 105 of the three-dimensional element. The height s is, for example, 5 to 95%, preferably 10 to 90%, of the height h of the three-dimensional element.

Figure 2:
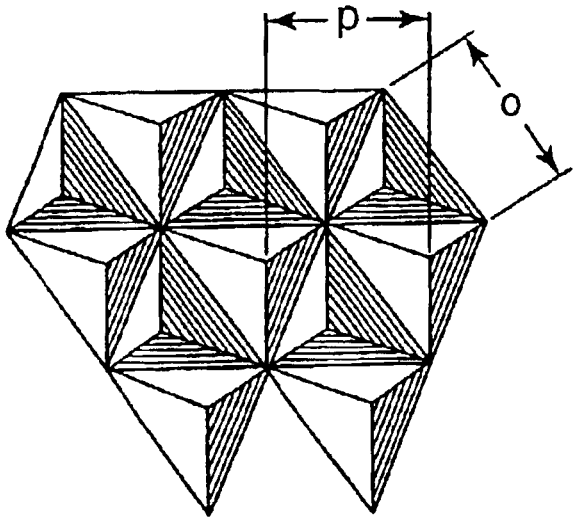
FIG. 2 is a top view illustrating an abrasive material having an abrasive layer of a three-dimensional structure according to an embodiment of the present invention.

FIG. 2 is a top view of this abrasive material. In FIG. 2, the symbol o represents the bottom side length of the three-dimensional element. The symbol p represents the distance between the tops of adjacent three-dimensional elements. The length o is, for example, 5 to 1000 μm, preferably 10 to 500 μm. The distance p is, for example, 5 to 1000 μm, preferably 10 to 500 μm.

Figure 3:
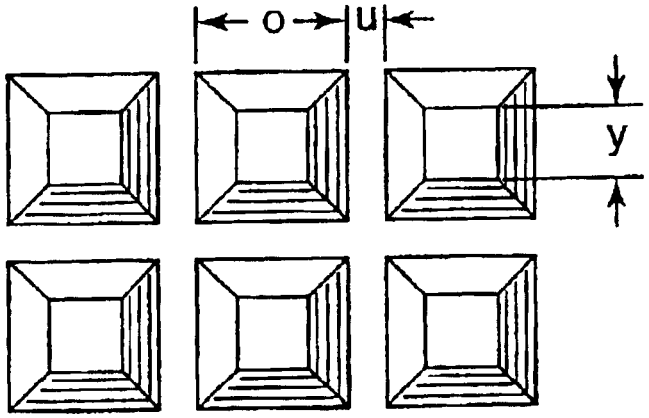
FIG. 3 is a top view illustrating an abrasive material having an abrasive layer of a three-dimensional structure according to an embodiment of the present invention.

In another embodiment, the three-dimensional element may have a tetrahedral or pyramidal shape whose top is truncated to a predetermined height. In this case, the top of the three-dimensional element is preferably formed of a triangular or quadrangular plane parallel to the surface of the base material, and substantially all of these planes are preferably located on a plane parallel to the surface of the base material. The height of the three-dimensional element is 5 to 95%, preferably 10 to 90%, of the height h of the three-dimensional element before truncation of the top. FIG. 3 is a top view of the abrasive material according to this embodiment.

In FIG. 3, the symbol o represents the bottom side length of the three-dimensional element. The symbol u represents a distance between bottom sides of adjacent three-dimensional elements. The symbol y represents the length of one side of the top plane. The length o is, for example, 5 to 2000 μm, preferably 10 to 1000 μm. The distance u is, for example, 0 to 1000 μm, preferably 2 to 500 μm. The length y is, for example, 0.5 to 1800 μm, preferably 1 to 900 μm.

Figure 4:
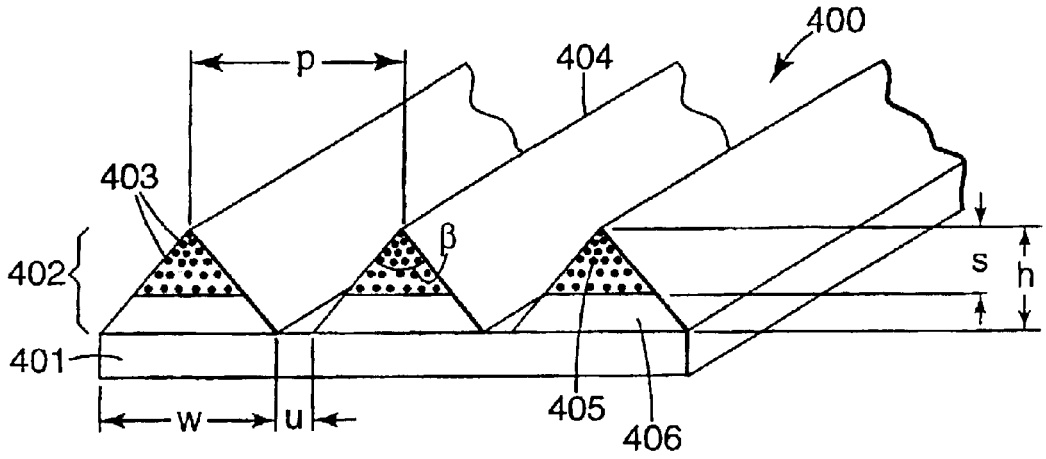
FIG. 4 is a perspective section view illustrating an abrasive material having an abrasive layer of a three-dimensional structure according to an embodiment of the present invention.

FIG. 4 is a perspective section view of an abrasive material having an abrasive layer of a three-dimensional structure according to another embodiment of the present invention. An abrasive material 400 is an abrasive material having a base material 401 and an abrasive layer 402 disposed on the surface of the base material.

The abrasive layer 402 has an abrasive composite containing a matrix of a binder and abrasive grains 403 dispersed therein as construction components.

The abrasive layer 402 has a three-dimensional structure constructed with a plurality of regularly arranged three-dimensional elements having a predetermined shape. The three-dimensional elements 404 has a prismatic shape formed of a laterally-placed triangular prism. The angle β of the three-dimensional element 404 is typically 30 to 150°, preferably 45 to 140°.

The ridges on the top of the three-dimensional elements 404 are located on a plane parallel to the surface of the base material substantially over an entire region of the abrasive material. In FIG. 4, the symbol h represents the height of the three-dimensional element from the surface of the base material. The height h is typically 2 to 600 μm, preferably 4 to 300 μm. The variation of the height of the top lines is preferably less than 20%, more preferably less than 10%, of the height of the three-dimensional element 404.

Like the three-dimensional element 104, the three-dimensional element 404 preferably has a two-layer structure including a top portion 405 made of an abrasive composite and a foot portion 406 made of a binder. In FIG. 4, the symbol s represents the height of the top portion of the three-dimensional element. The height s is, for example, 5 to 95%, preferably 10 to 90%, of the height h of the three-dimensional element.

Typically, the three-dimensional elements 404 are arranged in a stripe pattern. In FIG. 4, the symbol w represents the length of the short bottom side of the three-dimensional element (width of the three-dimensional element). The symbol p represents the distance between tops of adjacent three-dimensional elements. The symbol u represents the distance between long bottom sides of adjacent three-dimensional elements. The length w is, for example, 2 to 2000 μm, preferably 4 to 1000 μm. The distance p is, for example, 2 to 4000 μm, preferably 4 to 2000 μm. The distance u is, for example, 0 to 2000 μm, preferably 0 to 1000 μm.

Figure 5:
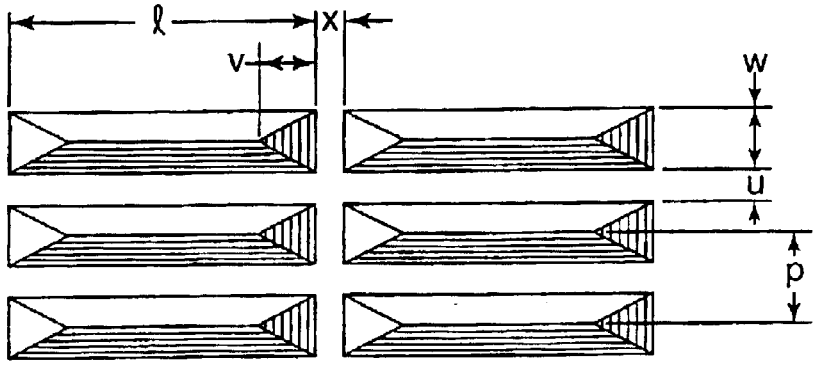
FIG. 5 is a top view illustrating an abrasive material having an abrasive layer of a three-dimensional structure according to an embodiment of the present invention.
Figure 6A:
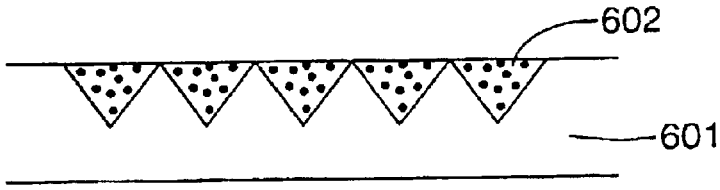
FIGS. 6(*a*) to 6(*e*) are model views illustrating steps for producing an abrasive material having an abrasive layer of a three-dimensional structure.
Figure 6B:
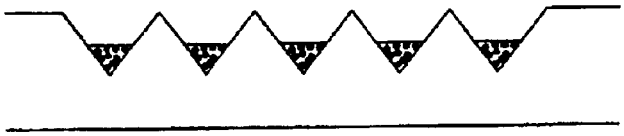
Figure 6C:
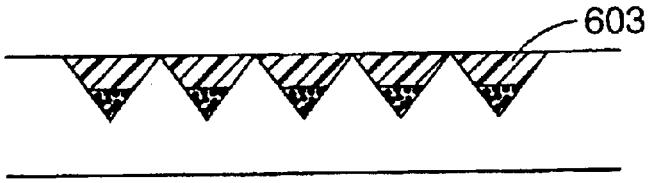
Figure 6D:
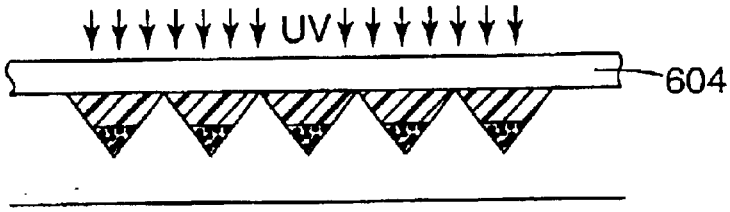
Figure 6E:
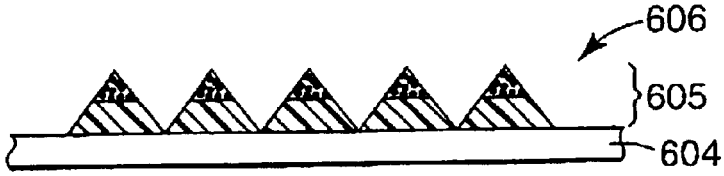

The length of the three-dimensional element may extend substantially over an entire region of the abrasive material. Alternatively, the length of the three-dimensional element may be cut to a suitable length. The ends of the three-dimensional elements may be either aligned or non-aligned. The ends of the prismatic three-dimensional elements may be cut at an acute angle from its bottom to form a house shape having four inclined surfaces. FIG. 5 is a top view of the abrasive material according to this embodiment.

In FIG. 5, the symbol l represents the length of a long bottom side of the three-dimensional element. The symbol v represents the distance of a portion of the three-dimensional element cut at an acute angle. The symbol x represents the distance between short bottom sides of adjacent three-dimensional elements. The symbols w, p, and u have the same meaning as in FIG. 4. The length l is, for example, 5 to 10000 μm, preferably 10 to 5000 μm. The distance v is, for example, 0 to 2000 μm, preferably 1 to 1000 μm. The distance x is, for example, 0 to 2000 μm, preferably 0 to 1000 μm. The length w is, for example, 2 to 2000 μm, preferably 4 to 1000 μm. The distance p is, for example, 2 to 4000 μm, preferably 4 to 2000 μm. The distance u is, for example, 0 to 2000 μm, preferably 0 to 1000 μm.

The abrasive material having an abrasive layer of a three-dimensional structure of the present invention exemplified in FIGS. 1 to 5 are particularly suited for use in abrading an end surface of an optical fiber connector, and can provide an end surface of an optical fiber connector with an extremely small connection loss. For example, the abrasive material having an abrasive layer of a three-dimensional structure according to the present invention provides an end surface of an optical fiber connector with a connection loss of less than 1.0 dB, or less than 0.5 dB.

The abrasive material of the present invention is preferably produced by the method described below.

First, an abrasive slurry is prepared which contains abrasive grains, a binder, and a solvent. The abrasive slurry to be used herein is a composition containing the binder, the abrasive grains, and optional additives such as a photoinitiator in sufficient amounts to constitute an abrasive composite and further containing a volatile solvent in a sufficient amount to impart fluidity to the mixture. Even if the content of the abrasive grains in the abrasive composite exceeds the critical pigment volume concentration, the fluidity can be maintained by allowing the abrasive slurry to contain a volatile solvent.

A preferable volatile solvent is an organic solvent that dissolves the binder and shows volatility at room temperature to 170° C. Specific examples of the organic solvent include methyl ethyl ketone, methyl isobutyl ketone, toluene, xylene, ethanol, isopropyl alcohol, ethyl acetate, butyl acetate, tetrahydrofuran, propylene glycol monomethyl ether, and propylene glycol monomethyl ether acetate. Another preferable solvent is water.

Next, a mold sheet is prepared which has a plurality of regularly arranged recesses tapered toward the bottom. The shape of the recesses may be an inverse of the three-dimensional elements to be formed. The mold sheet may be made of a metal such as nickel or plastics such as polypropylene. For example, a thermoplastic resin such as polypropylene is preferable because it can be embossed at its melting point on a metal tool to form recesses of a predetermined shape. Further, if the binder is a radiation-curing type resin, it is preferable to use a material that transmits ultraviolet rays and visible light. FIGS. 6(*a*) to 6(*e*) are model views showing steps for producing an abrasive material having an abrasive layer of a three-dimensional structure.

Referring to FIG. 6(*a*), the obtained mold sheet 601 is filled with an abrasive slurry 602. The amount of the abrasive slurry to be used in filling the mold sheet is such that it can form a top portion 105, 405 after the solvent is evaporated and the binder is hardened. Typically, the amount of the abrasive slurry may be such that its depth from the bottom is a dimension s shown in FIGS. 1 and 4 after the evaporation of the solvent.

The mold sheet can be filled with the abrasive slurry by applying the abrasive slurry onto the mold sheet by means of a coating apparatus such as a roll coater. The viscosity of the abrasive slurry for application is preferably adjusted to be 10 to 106 cps, particularly 100 to 105 cps.

Referring to FIG. 6(*b*), the solvent is evaporated and removed from the abrasive slurry. In doing this, the mold sheet filled with the abrasive slurry is heated to 50 to 150° C. for 0.2 to 10 minutes. If the binder is a thermoplastic resin, the mold sheet may be heated at its curing temperature for simultaneously performing a hardening step. If the volatility of the solvent is high, the mold sheet may be left to stand at room temperature for several minutes to several hours.

Referring to FIG. 6(*c*), the mold sheet is further filled with a binder 603 for lamination to fill the recesses with the binder. The lamination binder may be the same as or different from the one used in preparing the abrasive slurry. A binder having a good adhesion to the base material is preferable as the lamination binder.

Preferable examples of the lamination binder is acrylate resin, epoxy resin, and urethane resin. The mold sheet may be filled with the lamination binder in the same manner as the abrasive slurry.

Referring to FIG. 6(*d*), a base material 604 is superposed on the mold sheet 601 to allow the binder to adhere to the base material. The adhesion is carried by pressing with a roll for lamination.

The binder is hardened. The term "hardening" as used herein means that the binder is polymerized into a solid state. After the hardening, the specific shape of the abrasive layer does not change. The hardening of the binder in the abrasive slurry and the hardening of the lamination binder introduced alone at the later step may be performed either separately or simultaneously.

The binder is hardened by heat, infrared radiation, or by electron beam radiation, ultraviolet radiation, or by another radiation energy such as visible light radiation. The amount of radiation energy to be applied may vary depending on the type of the binder and the radiation energy source. Usually, those skilled in the art can suitably determine the amount of radiation energy to be applied. The period of time required in hardening may vary depending on the thickness, density, temperature of the binder, the properties of the composition, and others.

For example, the binder may be hardened by radiating ultraviolet rays (UV) from above the transparent base material.

Referring to FIG. 6(*e*), the mold sheet is removed to produce an abrasive material 606 composed of the base material 604 and the abrasive layer 605 having a three-dimensional structure. The binder may be hardened after the mold sheet is removed.

EXAMPLES

The present invention will be described in more detail by way of the following examples. However, the present invention is not limited by these examples.

Example 1

An abrasive material coating solution was prepared by mixing the components shown in Table 1.

TABLE 1

| Components | Weight (g) | Non-volatile component (%) | Weight after drying (g) |
|---|---|---|---|
| Diamond abrasive grains (particle size: 2 to 4 μm) "LS600F 2–4" (Lands Superabrasives, Co.) | 100.000 | 100.000 | 100.000 |
| Epoxy resin "YD-20N" (Toto Kasei Co., Ltd.) (as 50% MEK solution) | 17.500 | 50.000 | 8.750 |
| Urethane resin solution "EA-1443" (Daicel Kagaku Kogyo Co., Ltd.) | 29.545 | 55.000 | 16.250 |
| Methyl ethyl ketone (MEK) | 75.000 | 0.000 | 0.000 |
| Aerosol AY (AMERICAN CYANAMID COMPANY) (as 50% MEK solution) | 1.000 | 50.000 | 0.500 |
| Polyfunctional isocyanate "Coronate L" (Nippon Polyurethane Kogyo Co., Ltd.) | 12.564 | 75.000 | 9.423 |
| Total | 235.609 | 57.266 | 134.923 |

Abrasive grains/binder proportion = 2.91
Abrasive grains/(binder + additives) proportion = 2.86

A lamination binder was prepared by mixing the components shown in Table 2.

TABLE 2

| Components | Weight (g) | Non-volatile component (%) | Weight after drying (g) |
|---|---|---|---|
| Monoacrylate monomer "KAYARAD R-564" (Nippon Kayaku Co., Ltd.) | 50.000 | 100.000 | 50.000 |
| Diacrylate monomer "KAYARAD R-551" (Nippon Kayaku Co., Ltd.) | 50.000 | 100.000 | 50.000 |
| Benzophenone | 4.000 | 100.000 | 4.000 |
| 1,4-diazabicyclo[2.2.2]octane (DABCO) | 1.000 | 100.000 | 1.000 |
| Total | 105.000 | 400 | 105.000 |

A mold sheet made of polypropylene and having recesses with a shape of inverted three-dimensional elements shown in FIG. 4 was prepared. An abrasive slurry was applied onto the mold sheet by means of a roll coater and dried at 50° C. for 5 minutes. A lamination binder was applied thereon and further a transparent polyester film having a thickness of 75 μm was superposed and pressed by a roll for lamination. Ultraviolet rays were radiated from the polyester film side to harden the lamination binder. Subsequently, the binder of the abrasive slurry was hardened by heating at 70° C. for 24 hours.

The mold sheet was removed and the resultant was cooled to room temperature to produce an abrasive material. In the abrasive material, the abrasive layer has a three-dimensional structure having a prismatic shape arranged in a stripe pattern shown in FIG. 4. The dimensions thereof are shown in Table 3.

TABLE 3

| Symbol | Dimension (μm) |
|---|---|
| h | 25 |
| s | 15 |
| w | 50 |
| p | 50 |
| u | 0 |
| β | 90° |

This abrasive material was stamped out into a circular shape having a diameter of 110 mm to fabricate an abrasive disk. An end surface of an optical connector ferrule was abraded with the use of the obtained abrasive disk. The abrasion conditions are shown in Table 4.

TABLE 4

| | |
|---|---|
| Abrader | "OFL-12" made by Seiko Denshi Kogyo Co., Ltd. |
| Load | Point 2 (about 1.5 kg/cm$^2$) |
| Cooling liquid | Purified water |
| Number of abraded samples | 12 |

Figure 7:
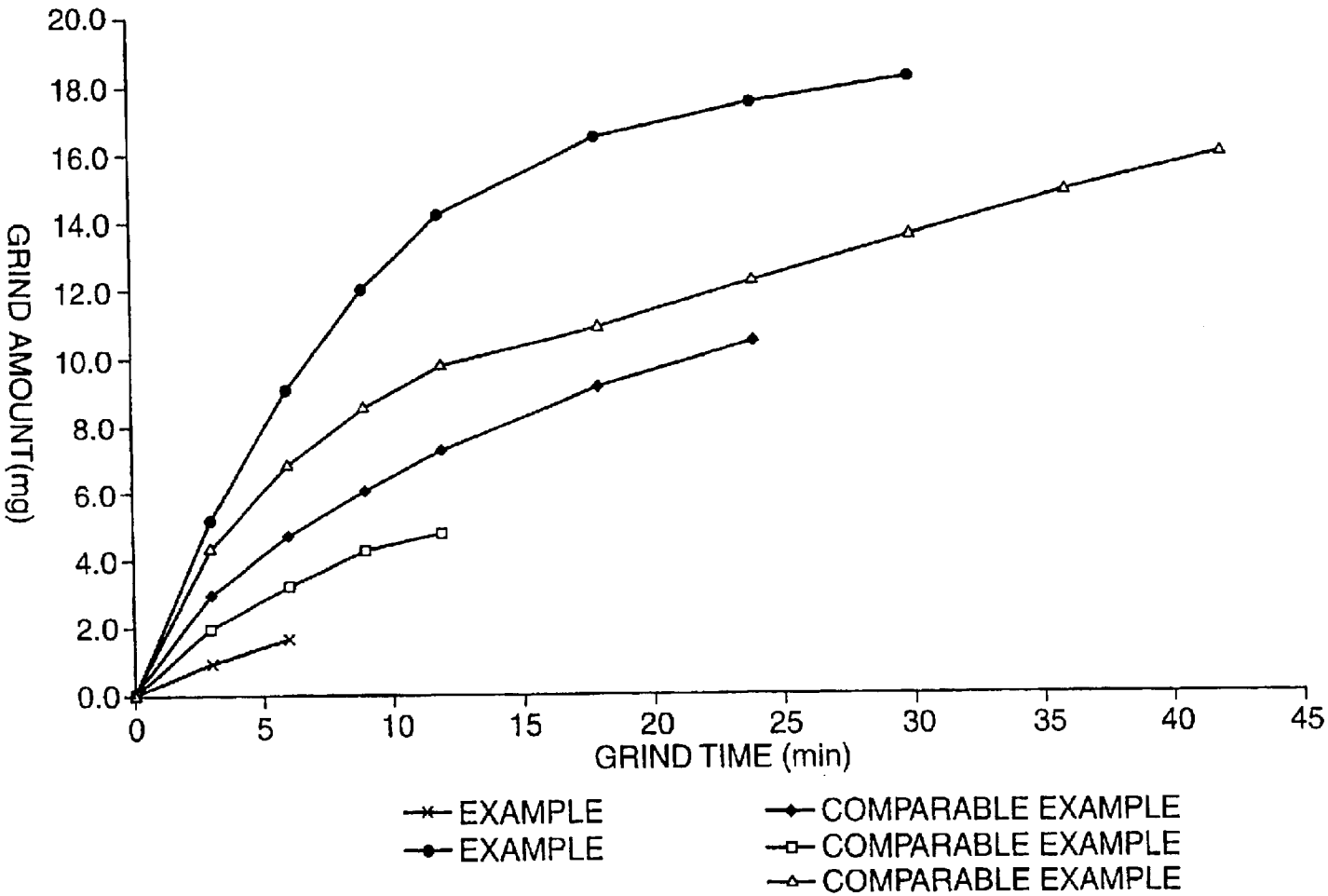
FIG. 7 is a graph showing change with time of an abraded amount when an end surface of an optical fiber connector is abraded with various abrasive materials.
Figure 8:
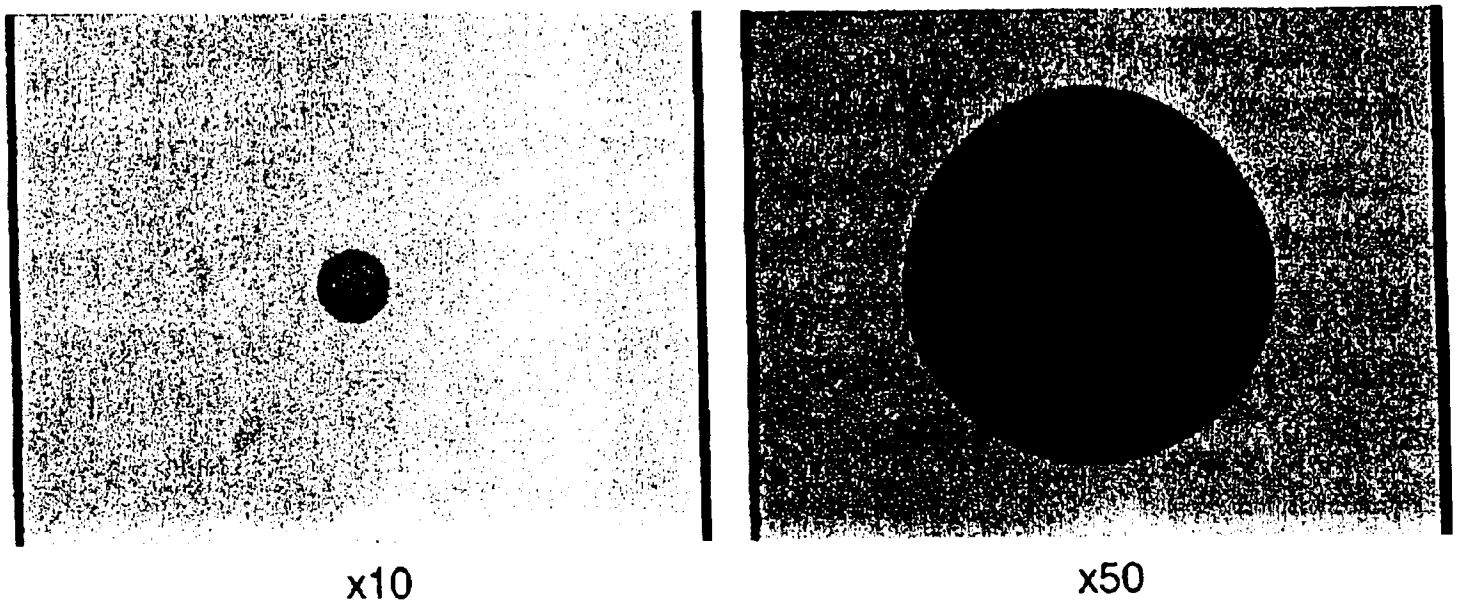
FIG. 8 is a microscope photograph of an end surface of an optical fiber connector after being abraded with the abrasive material of the present invention.

The change with time of the abraded amount is shown in FIG. 7. After the abrasion, the end surface of the optical connector ferrule was observed by an electron microscope, whereby a smooth surface was confirmed. The obtained microscope photograph is shown in FIG. 8.

Example 2

An abrasive slurry was prepared by mixing the components shown in Table 5.

TABLE 5

| Components | Weight (g) | Non-volatile component (%) | Weight after drying (g) |
|---|---|---|---|
| Diamond abrasive grains (particle size: 2 to 4 μm) "LS600F 2–4" (Lands Superabrasives, Co.) | 150.000 | 100.000 | 150.000 |
| Epoxy resin solution "YDCN-703PEK75" (Toto Kasei Co., Ltd.) | 66.670 | 75.000 | 50.003 |
| Methyl ethyl ketone (MEK) | 40.500 | 0.000 | 0.000 |
| Propylene glycol monomethyl ether (PGM) | 34.500 | 0.000 | 0.000 |
| 2-methylimidazole (2MZ) (20% propylene glycol monomethyl ether solution) | 12.501 | 20.000 | 2.500 |
| Total | 304.171 | 66.575 | 202.503 |

Abrasive grains/binder proportion = 2.86
Abrasive grains/(binder + additives) proportion = 2.86

Figure 9:
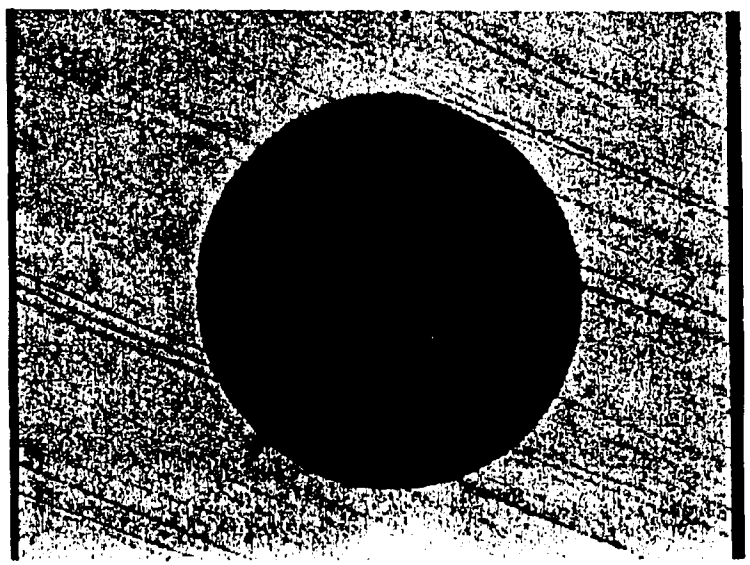
FIG. 9 is a microscope photograph of an end surface of an optical fiber connector after being abraded with the abrasive material of the present invention.
Figure 9:
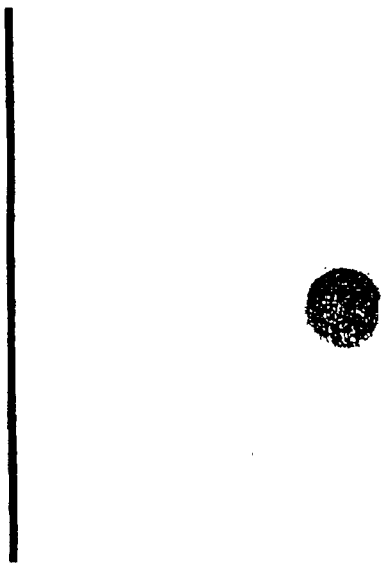

An abrasive disk was fabricated in the same manner as in Example 1 except that this abrasion slurry was used, and an end surface of an optical connector ferrule was abraded. The change with time of the abraded amount is shown in FIG. 7. After the abrasion, the end surface of the optical connector ferrule was observed by an electron microscope, whereby a smooth surface was confirmed. The obtained microscope photograph is shown in FIG. 9.

Comparative Example 1

Figure 10:
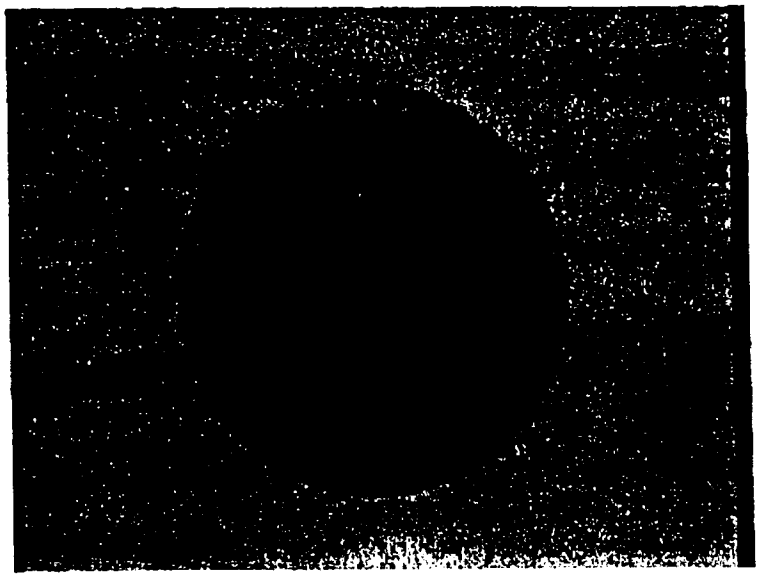
FIG. 10 is a microscope photograph of an end surface of an optical fiber connector after being abraded with the abrasive material of the prior art.
Figure 10:
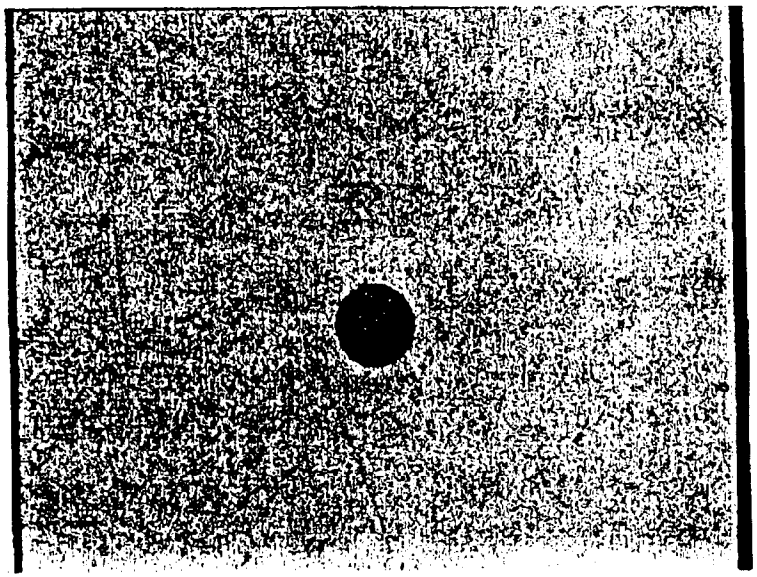

An abrasive material "Imperial Sign Diamond Lapping Film 3 Mil 3 Micron Type H" made by Minnesota Mining and Manufacturing Co., Ltd. was stamped out into a circular shape having a diameter of 110 mm to fabricate an abrasive disk. An end surface of an optical connector ferrule was abraded in the same manner as in Example 1 except that this abrasive disk was used. The change with time of the abraded amount is shown in FIG. 7. After the abrasion, the end surface of the optical connector ferrule was observed by an electron microscope, whereby a rough surface was confirmed. The obtained microscope photograph is shown in FIG. 10.

Comparative Example 2

The abrasive slurry prepared in Example 1 was applied onto a polyester film having a thickness of 75 μm by means of a knife coater and the solvent was removed by evaporation to form an abrasive layer having a thickness of 11 μm. The abrasive layer was heated at 70° C. for 24 hours to harden the binder. The obtained abrasive material was stamped out into a circular shape having a diameter of 110 mm to fabricate an abrasive disk.

Figure 11:
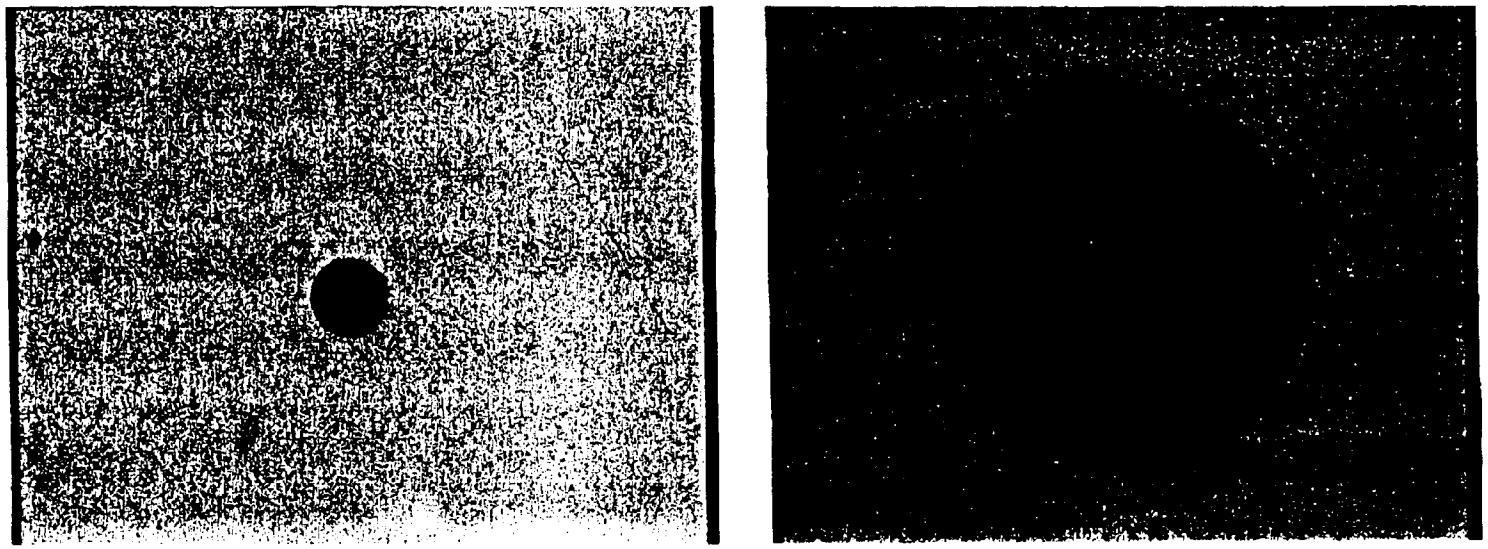
FIG. 11 is a microscope photograph of an end surface of an optical fiber connector after being abraded with the abrasive material of the prior art.

An end surface of an optical connector ferrule was abraded in the same manner as in Example 1 except that this abrasive disk was used. The change with time of the abraded amount is shown in FIG. 7. After the abrasion, the end surface of the optical connector ferrule was observed by an electron microscope, whereby a rough surface was confirmed. The obtained microscope photograph is shown in FIG. 11.

Comparative Example 3

The abrasive slurry prepared in Example 2 was applied onto a polyester film having a thickness of 75 μm by means of a knife coater and the solvent was removed by evaporation to form an abrasive layer having a thickness of 11 μm. The abrasive layer was heated at 70° C. for 24 hours to harden the binder. The obtained abrasive material was stamped out into a circular shape having a diameter of 110 mm to fabricate an abrasive disk.

Figure 12:
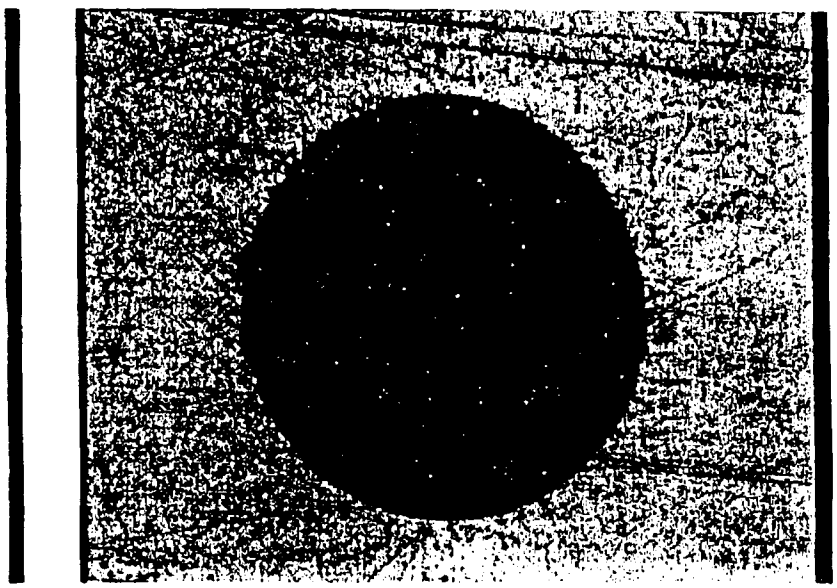
FIG. 12 is a microscope photograph of an end surface of an optical fiber connector after being abraded with the abrasive material of the prior art.
Figure 12:
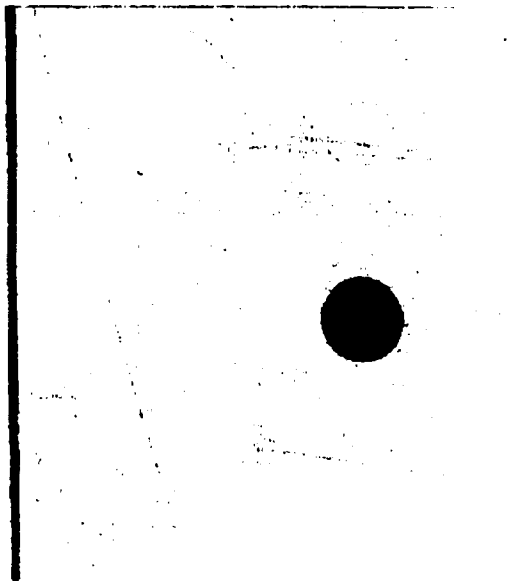

An end surface of an optical connector ferrule was abraded in the same manner as in Example 1 except that this abrasive disk was used. The change with time of the abraded amount is shown in FIG. 7. After the abrasion, the end surface of the optical connector ferrule was observed by an electron microscope, whereby a rough surface was confirmed. The obtained microscope photograph is shown in FIG. 12.

By comparing FIGS. 8 and 9 with FIG. 10, it will be understood that the abrasive materials of Examples 1 and 2 give a more smooth abraded surface than the abrasive material of Comparative Example 1 which is a current product. Also, by comparing FIG. 8 with FIG. 11, it will be understood that the abrasive material of Example 1 gives a more smooth surface than the abrasive material of Comparative Example 2 which is an abrasive material made of the same slurry but having an abrasive layer without a three-dimensional structure. By comparing FIG. 9 with FIG. 12, it will be understood that the abrasive material of Example 2 gives a more smooth surface than the abrasive material of Comparative Example 3 which is an abrasive material made of the same slurry but having an abrasive layer without a three-dimensional structure.

From the graph shown in FIG. 7, it will be understood that the abrasive disk of Example 2 exhibits a higher abrasive property than the abrasive disks of Comparative Examples 1 to 3.

Example 3

An abrasive slurry was prepared by mixing the components shown in Table 6.

TABLE 6

| Components | Weight (g) | Non-volatile component (%) | Weight after drying (g) |
|---|---|---|---|
| Colloidal silica "Snowtechs IPA-ST" (Nissan Kagaku Kogyo Co., Ltd.) | 100.00 | 30.000 | 30.00 |
| Diacrylate monomer "KAYARAD HDDA" (Nippon Kayaku Co., Ltd.) | 15.00 | 100.000 | 15.00 |
| Photoinitiator "Irgacure 369" (CIBA-GEIGY) | 0.30 | 100.000 | 0.30 |
| Total | 115.30 | 46.030 | 45.30 |

Abrasive grains/binder proportion = 2.00
Abrasive grains/(binder + additives) proportion = 1.96

The same mold sheet made of polypropylene as used in Example 1 was prepared. An abrasive slurry was applied onto the mold sheet by means of a roll coater and dried at 60° C. for 5 minutes. A lamination binder prepared in Example 1 was applied thereon and further a transparent polyester film having a thickness of 75 μm was superposed and pressed by a roll for lamination. Ultraviolet rays were radiated from the polyester film side to harden the binder. The mold sheet was removed and the resultant was cooled to room temperature to produce an abrasive material. This abrasive material was stamped out into a circular shape having a diameter of 110 mm to fabricate an abrasive disk.

In the meantime, an optical connector ferrule was prepared and an end surface thereof was abraded under the same abrasion condition as in Table 7 with the use of an abrasive material "Imperial Sign Diamond Lapping Film 3 Mil 0.5 Micron Type H" made by Minnesota Mining and Manufacturing Co., Ltd. An end surface of this optical connector ferrule was further abraded with the use of the fabricated abrasive disk. The abrasion condition is shown in Table 7.

TABLE 7

| | |
|---|---|
| Abrader | "OFL-12" made by Seiko Denshi Kogyo Co., Ltd. |
| Load | Point 3 (about 2 kg/cm$^2$) |
| Number of abraded samples | 6 |

Figure 13:
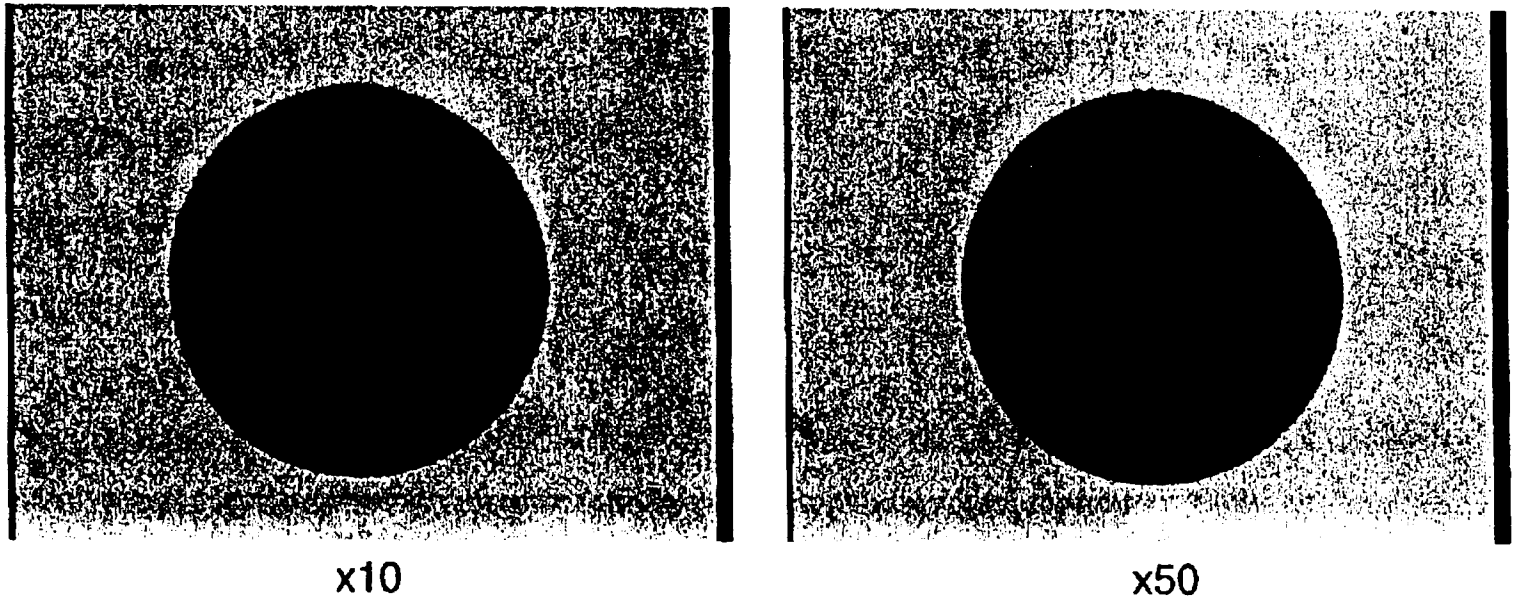
FIG. 13 is a microscope photograph of an end surface of an optical fiber connector after being abraded with the abrasive material of the present invention.

After the abrasion, the end surface of the optical connector ferrule was observed by an electron microscope, whereby a smooth surface was confirmed. The obtained microscope photograph is shown in FIG. 13.

The shape of the end surface of the optical connector ferrule after the abrasion was measured by means of "Zoom Interferometer ZX-1 Mini PMS" made by Direct Optical Research Company (DORC), and the reflected damping amount was measured by means of "Back Reflection Meter RM300A" made by JDS FITEL. The results are shown in Table 9.

Example 4

An abrasive slurry was prepared by mixing the components shown in Table 8.

TABLE 8

| Components | Weight (g) | Non-volatile component (%) | Weight after drying (g) |
|---|---|---|---|
| Colloidal silica "Snowtechs IPA-ST" (Nissan Kagaku Kogyo Co., Ltd.) | 100.00 | 30.000 | 30.00 |
| Diacrylate monomer "KAYARAD HDDA" (Nippon Kayaku Co., Ltd.) | 7.50 | 100.000 | 7.50 |
| Monoacrylate monomer "KAYARAD R-564" (Nippon Kayaku Co., Ltd.) | 7.50 | 100.000 | 7.50 |
| Photoinitiator "Irgacure 369" (CIBA-GEIGY) | 0.30 | 100.000 | 0.30 |
| Total | 115.30 | 46.030 | 45.30 |

Abrasive grains/binder proportion = 2.00
Abrasive grains/(binder + additives) proportion = 1.96

Figure 14:
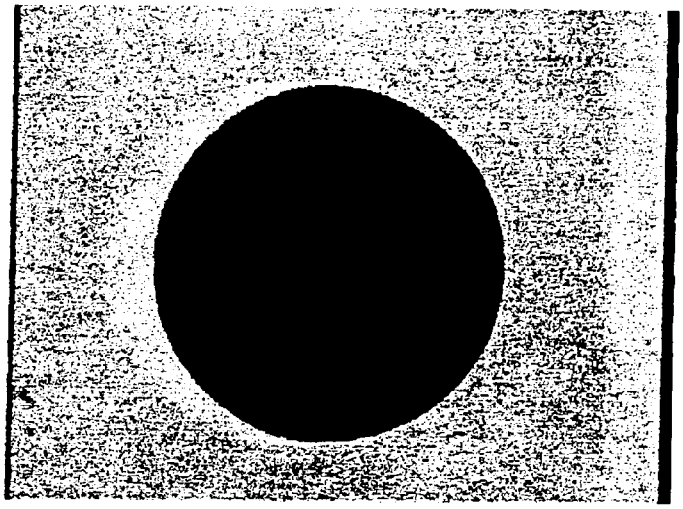
FIG. 14 is a microscope photograph of an end surface of an optical fiber connector after being abraded with the abrasive material of the present invention.

An abrasive disk was fabricated in the same manner as in Example 3 except that this abrasive slurry was used, and an end surface of an optical connector ferrule was abraded. A microscope photograph of the end surface after the abrasion is shown in FIG. 14. The shape of the end surface and the reflected damping amount are shown in Table 9.

Comparative Example 4

Figure 15:
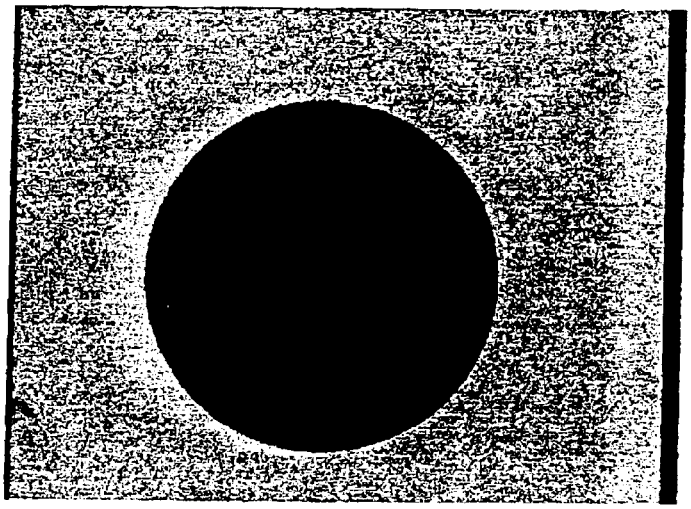
FIG. 15 is a microscope photograph of an end surface of an optical fiber connector after being abraded with the abrasive material of the prior art.

An abrasive material "Imperial Sign Diamond Lapping Film 3 Mil 0.05 Micron AO Type P" made by Minnesota Mining and Manufacturing Co., Ltd. was stamped out into a circular shape having a diameter of 110 mm to fabricate an abrasive disk. An end surface of an optical connector ferrule was abraded in the same manner as in Example 3 except that this abrasive disk was used. A microscope photograph of the end surface after the abrasion is shown in FIG. 15. The shape of the end surface and the reflected damping amount are shown in Table 9.

Comparative Example 5

The abrasive slurry prepared in Example 3 was applied onto a polyester film having a thickness of 75 μm by means of a knife coater and the solvent was removed by evaporation to form an abrasive layer having a thickness of 4 μm. A polyester film having a thickness of 31 μm was laminated on this abrasive layer, and the binder was hardened by radiating ultraviolet rays. The obtained abrasive material was stamped out into a circular shape having a diameter of 110 mm to fabricate an abrasive disk.

An end surface of an optical connector ferrule was abraded in the same manner as in Example 3 except that this abrasive disk was used. However, attachments accumulated on the end surface during the abrasion, making it impossible to perform effective abrasion.

Comparative Example 6

The abrasive slurry prepared in Example 4 was applied onto a polyester film having a thickness of 75 μm by means of a knife coater and the solvent was removed by evaporation to form an abrasive layer having a thickness of 4 μm. A polyester film having a thickness of 31 μm was laminated on this abrasive layer, and the binder was hardened by radiating ultraviolet rays. The obtained abrasive material was stamped out into a circular shape having a diameter of 110 mm to fabricate an abrasive disk.

An end surface of an optical connector ferrule was abraded in the same manner as in Example 3 except that this abrasive disk was used. However, attachments accumulated on the end surface during the abrasion, making it impossible to perform effective abrasion.

TABLE 9

| | Abrasive material samples | | | | | | | |
|---|---|---|---|---|---|---|---|---|
| | Example 3 | | Example 4 | | Example 4 | | Comparative Example 4 | |
| | Coolant | | | | | | | |
| | Pure water | | Pure water | | 2-propanol | | Pure water | |
| Measurement parameters | Mean | σ | Mean | σ | Mean | σ | Mean | σ |
| Radius of curvature (mm) | 15.10 | 1.56 | 17.15 | 3.90 | 18.91 | 5.05 | 14.73 | 0.84 |
| Fiber height (Spherical Fit: nm) | 28.06 | 7.7 | 9.4 | 8.4 | −60.3 | 34.9 | −31.5 | 3.9 |
| Fiber height (Planar Fit: nm) | 163.0 | 20.7 | 132.9 | 38.9 | 52.9 | 10.1 | 106.1 | 8.7 |
| Diameter (m) | 126.9 | 0.3 | 126.7 | 0.3 | 126.6 | 0.3 | 127.3 | 0.4 |
| Reflected damping amount (dB) | 46.1 | 0.2 | 44.7 | 1.1 | 47.3 | 2.2 | 41.7 | 0.5 |

As shown in FIGS. 13 and 14, when the abrasive materials of Examples 3 and 4 were used, the abrasion streaks created by abrasion with the abrasive material "Imperial Sign Diamond Lapping Film 3 Mil 0.5 Micron Type H" made by Minnesota Mining and Manufacturing Co., Ltd. (FIG. 10) disappeared by abrasion of 60 seconds. This end surface of the optical connector ferrule had been extremely smoothly and finely abraded and, as shown in Table 9, the reflected damping amount was extremely small compared with Comparative Example 4. The abrasive material of Example 4 showed an extremely good result when abrasion was performed with the use of 2-propanol as the cooling liquid.

Example 5

An abrasive slurry was prepared by mixing the components shown in Table 10.

TABLE 10

| Components | Weight (g) | Non-volatile component (%) | Weight after drying (g) |
|---|---|---|---|
| Diamond abrasive grains (particle size: 7 to 10 μm) "LS600F 7–10" (Lands Superabrasives, Co.) | 100.000 | 100.000 | 100.000 |
| Epoxy resin solution "YDCN-703PEK75" (Toto Kasei Co., Ltd.) | 46.667 | 75.000 | 35.000 |
| Methyl ethyl ketone (MEK) | 40.000 | 0.000 | 0.000 |
| Aerosol AY (AMERICAN CYANAMID COMPANY) (as 50% MEK solution) | 1.000 | 50.000 | 0.500 |
| 2-methylimidazole (2MZ) (20% propylene glycol monomethyl ether solution) | 8.750 | 20.000 | 1.750 |
| Total | 196.417 | 69.877 | 137.25 |

Abrasive grains/binder proportion = 2.72
Abrasive grains/(binder + additives) proportion = 2.69

The same mold sheet made of polypropylene as used in Example 1 was prepared. An abrasive slurry was applied onto the mold sheet by means of a roll coater and dried at 70° C. for 5 minutes. A lamination binder prepared in Example 1 was applied thereon and further a transparent polyester film having a thickness of 75 μm was superposed and pressed by a roll for lamination. Ultraviolet rays were radiated from the polyester film side to harden the lamination binder. Subsequently, the binder in the abrasive slurry was hardened by heating at 70° C. for 24 hours.

The resultant was cooled to room temperature and the mold sheet was removed to produce an abrasive material. This abrasive material was stamped out into a circular shape having a diameter of 110 mm to fabricate an abrasive disk.

A circular rod of zirconia (diameter: 3 mm) was abraded with the use of the fabricated abrasive disk. The abrasion conditions are shown in Table 11.

TABLE 11

| | |
|---|---|
| Abrader | "OFL-12" made by Seiko Denshi Kogyo Co., Ltd. |
| Load | Point 1 (about 2.5 k2/cm$^2$) |
| Cooling liquid | Purified water |
| Number of abraded samples | 6 |

Figure 16:
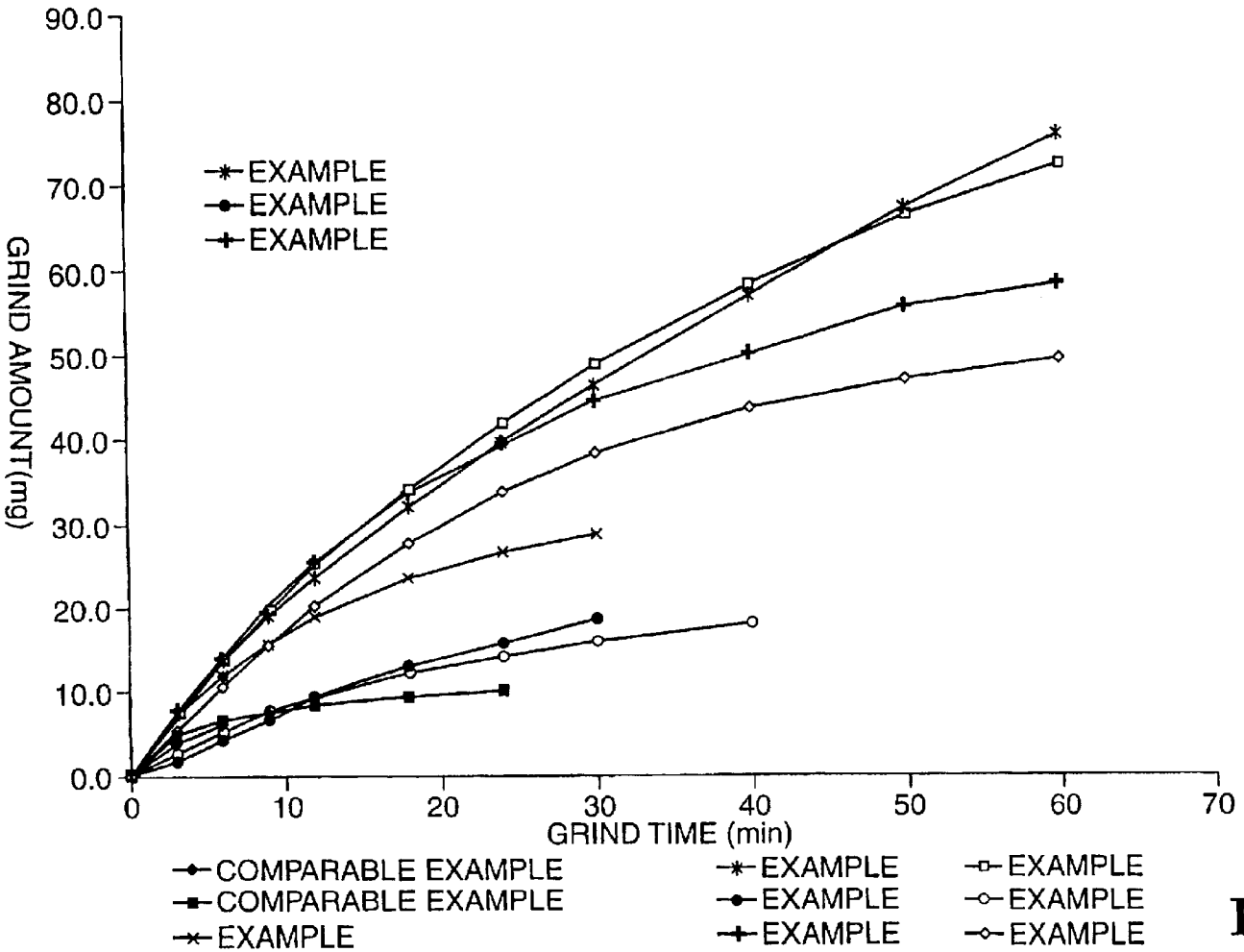
FIG. 16 is a graph showing change with time of an abraded amount when a circular rod of zirconia is abraded with various abrasive materials.

The change with time of the abraded amount is shown in FIG. 16.

Subsequently, the abrasive disk was replaced with a new one, and the end surface of the optical connector ferrule was abraded. The abrasion condition is shown in Table 12.

TABLE 12

| | |
|---|---|
| Abrader | "OFL-12" made by Seiko Denshi Kogyo Co.. Ltd. |
| Load | Point 1 (about 2.5 kg/cm$^2$) |
| Cooling liquid | Purified water |
| Number of abraded samples | 12 |

Figure 17:
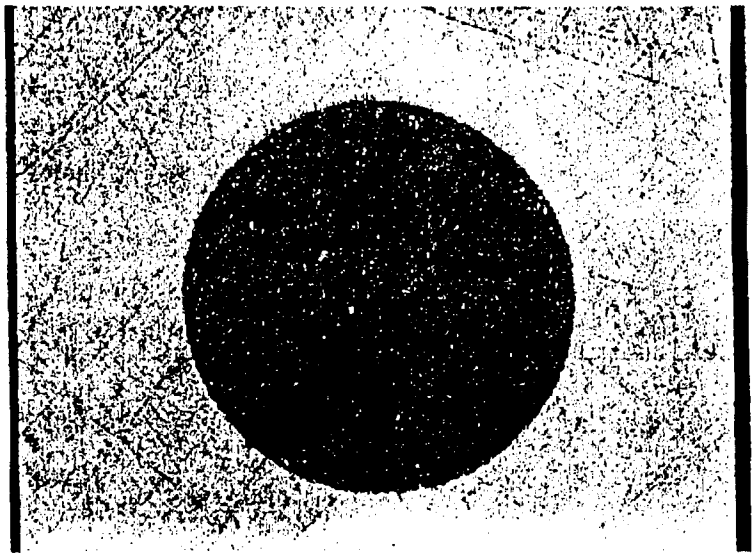
FIG. 17 is a microscope photograph of an end surface of an optical fiber connector after being abraded with the abrasive material of the present invention.
Figure 17:
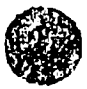

After the abrasion, the end surface of the optical connector ferrule was observed by an electron microscope, whereby a smooth surface was confirmed. A microscope photograph is shown in FIG. 17.

Example 6

An abrasive material was fabricated in the same manner as in Example 5 except that a mold sheet made of polypropylene and having recesses with a shape of inverted three-dimensional elements shown in FIG. 5 was used. In this abrasive material, the abrasive layer has a three-dimensional structure of a house shape arranged in a stripe pattern as shown in FIG. 5. The dimensions are shown in Table 13.

TABLE 13

| Symbol | Dimension (μm) |
|---|---|
| h* | 20 μm |
| s* | 14 μm |
| w | 40 μm |
| p | 50 μm |
| u | 10 μm |
| l | 280 μm |
| v | 40 to 80 μm |
| x | 30 μm |
| β* | 90° |

The symbols h, s, and β represent the height of the three-dimensional element, the height of the top portion of the three-dimensional element, and the angle shown in FIG. 4, respectively.

Figure 18:
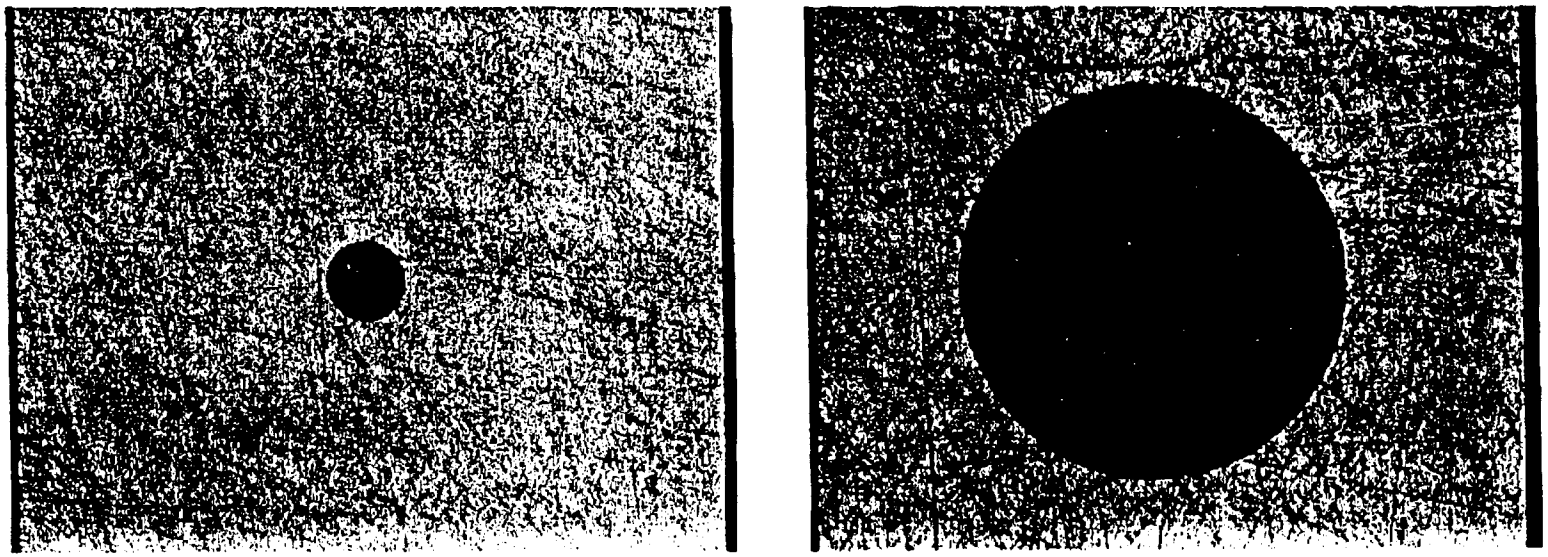
FIG. 18 is a microscope photograph of an end surface of an optical fiber connector after being abraded with the abrasive material of the present invention.

The obtained abrasive material was stamped out into a circular disk having a diameter of 110 mm to fabricate an abrasive disk. A circular rod of zirconia and an end surface of an optical connector ferrule were abraded with the use of this abrasive disk in the same manner as in Example 5. The change with time of the abraded amount of the circular rod of zirconia is shown in FIG. 16. The end surface of the optical connector ferrule was observed by an electron microscope, whereby a smooth surface was confirmed. A microscope photograph is shown in FIG. 18.

Example 7

An abrasive material was fabricated in the same manner as in Example 5 except that a mold sheet made of polypropylene and having recesses with a shape of inverted three-dimensional elements shown in FIGS. 1 and 2 was used. In this abrasive material, the abrasive layer has a three-dimensional structure of a tetrahedral shape most closely packed as shown in FIGS. 1 and 2. The dimensions are shown in Table 14.

TABLE 14

| Symbol | Dimension (μm) |
|---|---|
| h | 63 μm |
| s | 50 μm |
| o | 190 μm |
| p | 190 μm |
| α | 90° |

Figure 19:
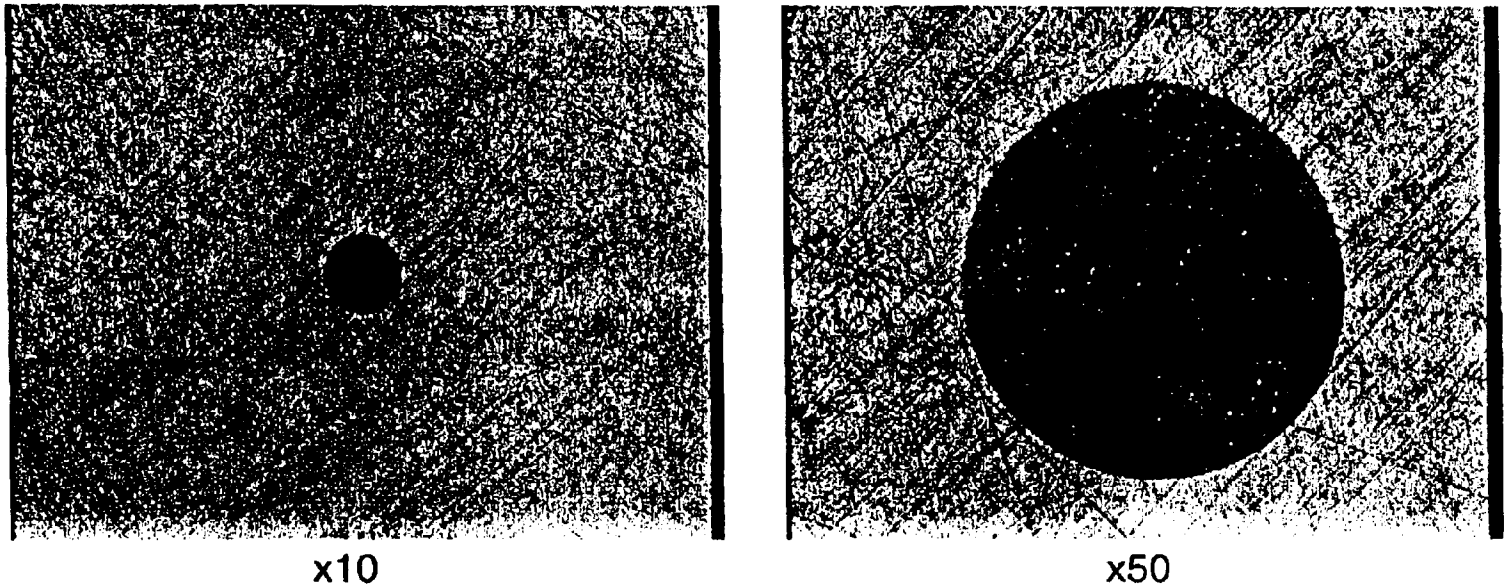
FIG. 19 is a microscope photograph of an end surface of an optical fiber connector after being abraded with the abrasive material of the present invention.

The obtained abrasive material was stamped out into a circular disk having a diameter of 110 mm to fabricate an abrasive disk. A circular rod of zirconia and an end surface of an optical connector ferrule were abraded with the use of this abrasive disk in the same manner as in Example 5. The change with time of the abraded amount of the circular rod of zirconia is shown in FIG. 16. The end surface of the optical connector ferrule was observed by an electron microscope, whereby a smooth surface was confirmed. A microscope photograph is shown in FIG. 19.

Example 8

An abrasive material was fabricated in the same manner as in Example 5 except that a mold sheet made of polypropylene and having recesses with a shape of inverted three-dimensional elements shown in FIG. 4 and being of a different type from the one used in Example 5 was used. In this abrasive material, the abrasive layer has a three-dimensional structure of a prismatic shape arranged in a stripe pattern as shown in FIG. 4. The dimensions are shown in Table 15.

TABLE 15

| Symbol | Dimension (μm) |
|---|---|
| h | 75 μm |
| s | 50 μm |
| w | 180 μm |
| p | 180 μm |
| u | 0 μm |
| β | 100° |

Figure 20:
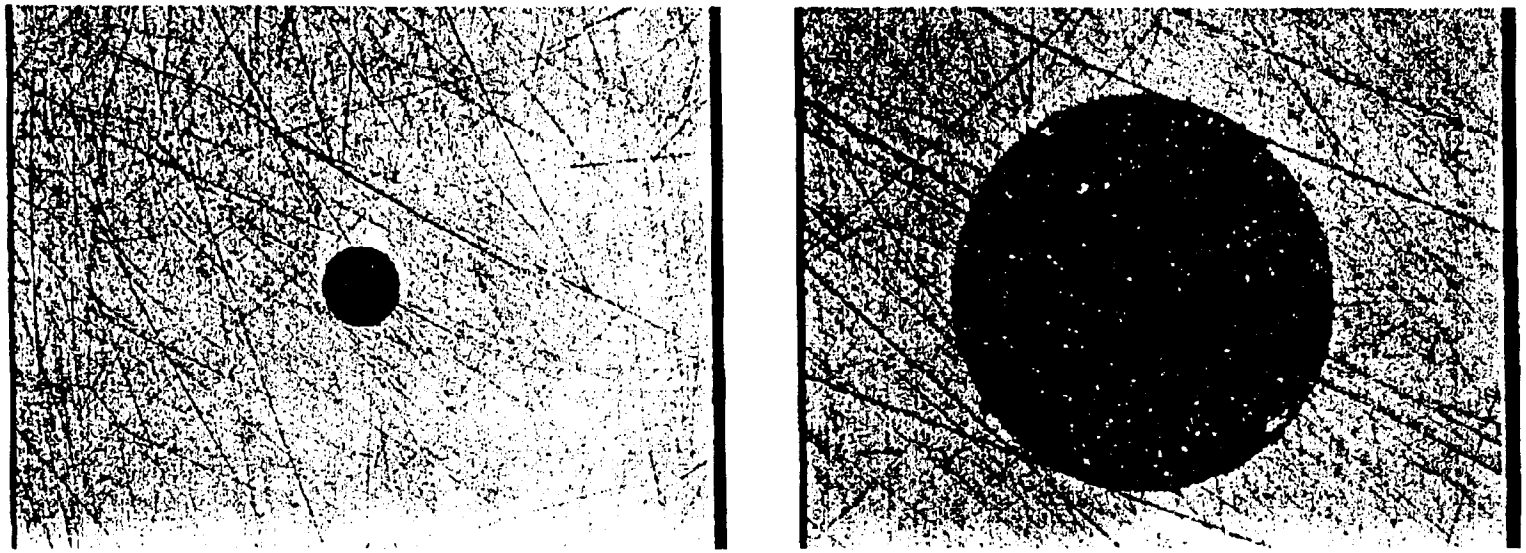
FIG. 20 is a microscope photograph of an end surface of an optical fiber connector after being abraded with the abrasive material of the present invention.

The obtained abrasive material was stamped out into a circular disk having a diameter of 110 mm to fabricate an abrasive disk. A circular rod of zirconia and an end surface of an optical connector ferrule were abraded with the use of this abrasive disk in the same manner as in Example 5. The change with time of the abraded amount of the circular rod of zirconia is shown in FIG. 16. The end surface of the optical connector ferrule was observed by an electron microscope, whereby a smooth surface was confirmed. A microscope photograph is shown in FIG. 20.

Comparative Example 7

Figure 21:
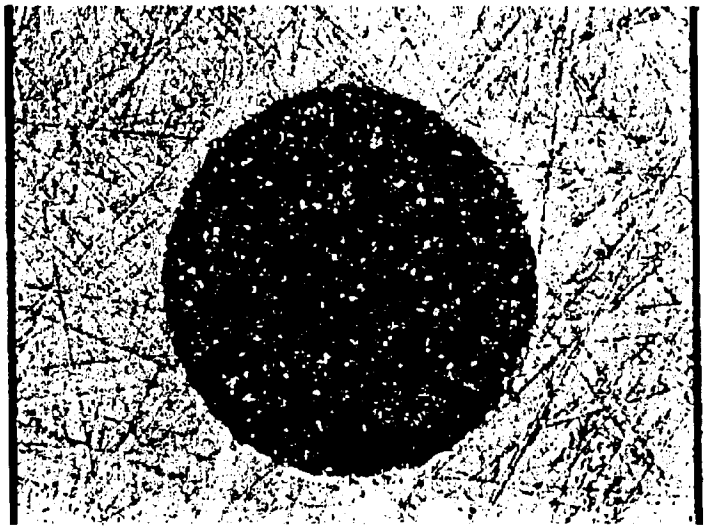
FIG. 21 is a microscope photograph of an end surface of an optical fiber connector after being abraded with the abrasive material of the prior art.
Figure 21:
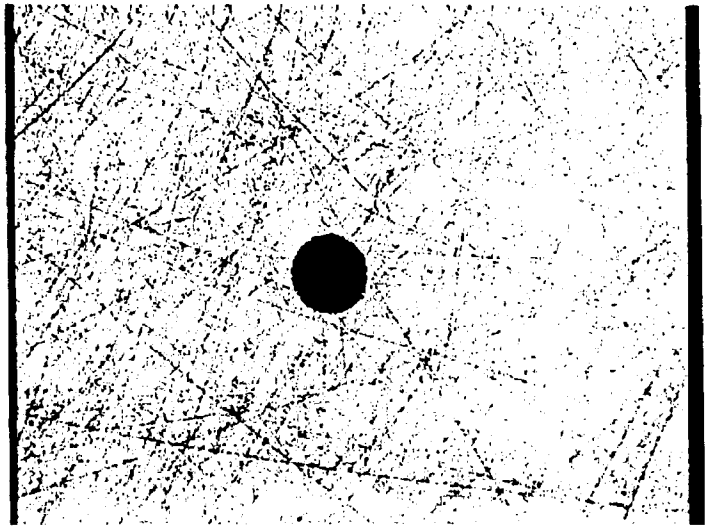

An abrasive material "Imperial Sign Diamond Lapping Film 3 Mil 9 Micron Type H" made by Minnesota Mining and Manufacturing Co., Ltd. was stamped out into a circular shape having a diameter of 10 mm to fabricate an abrasive disk. A circular rod of zirconia and an end surface of an optical connector ferrule were abraded in the same manner as in Example 5 except that this abrasive disk was used. The change with time of the abraded amount of the circular rod of zirconia is shown in FIG. 16. The end surface of the optical connector ferrule was observed by an electron microscope, whereby a rough surface was confirmed. A microscope photograph is shown in FIG. 21.

Comparative Example 8

The abrasive slurry prepared in Example 5 was applied onto a polyester film having a thickness of 75 μm by means of a knife coater and the solvent was removed by evaporation to form an abrasive layer having a thickness of 14 μm. The abrasive layer was heated at 70° C. for 24 hours and further heated at 100° C. for 24 hours to harden the binder. The abrasive material obtained by cooling to room temperature was stamped out into a circular shape having a diameter of 110 mm to fabricate an abrasive disk.

Figure 22:
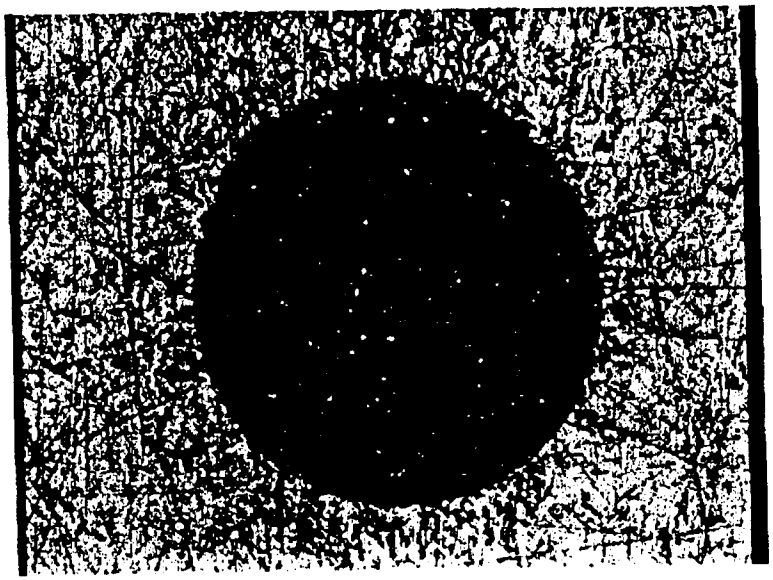
FIG. 22 is a microscope photograph of an end surface of an optical fiber connector after being abraded with the abrasive material of the prior art.
Figure 22:
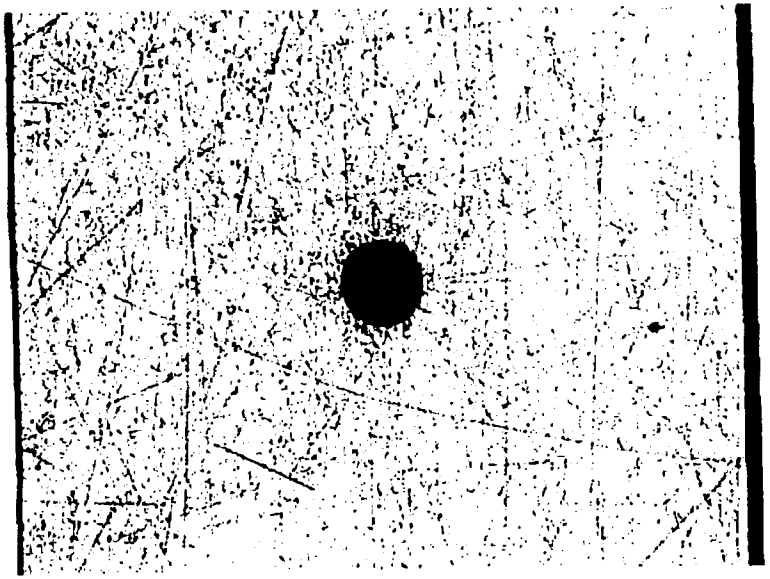

A circular rod of zirconia and an end surface of an optical connector ferrule were abraded in the same manner as in Example 6 except that this abrasive disk was used. The change with time of the abraded amount of the circular rod of zirconia is shown in FIG. 16. The end surface of the optical connector ferrule was observed by an electron microscope, whereby a rough surface was confirmed. A microscope photograph is shown in FIG. 22.

Example 9

An abrasive slurry was prepared by mixing the components shown in Table 16.

TABLE 16

| Components | Weight (g) | Non-volatile component (%) | Weight after drying (g) |
|---|---|---|---|
| Diamond abrasive grains (particle size: 7 to 10 μm) "LS600F 7–10" (Lands Superabrasives, Co.) | 100.000 | 100.000 | 100.000 |
| Resol-phenolic resin (non-volatile component 60%, water 20%, organic solvent 20%) | 58.333 | 60.000 | 35.000 |
| Propylene glycol monomethyl ether (PGM) | 50.000 | 0.000 | 0.000 |
| Aerosol AY (AMERICAN CYANAMID COMPANY) (as 50% MEK solution) | 1.000 | 50.000 | 0.500 |
| Total | 209.333 | 64.729 | 135.500 |

Abrasive grains/binder proportion = 2.86
Abrasive grains/(binder + additives) proportion = 2.82

A lamination binder was prepared by mixing the components shown in Table 17.

TABLE 17

| Components | Weight (g) | Non-volatile component (%) | Weight after drying (g) |
|---|---|---|---|
| Epoxy resin "YD-128R" (Toto Kasei Co., Ltd.) | 96.000 | 100.000 | 96.000 |
| 2-ethyl-4-methylimidazole (2E4MZ) | 4.000 | 100.000 | 4.000 |
| Total | 100.000 | 100.000 | 100.000 |

The same mold sheet made of polypropylene as used in Example 1 was prepared. An abrasive slurry was applied onto the mold sheet by means of a roll coater and dried at 70° C. for 5 minutes. The lamination binder was applied thereon and further a transparent polyester film having a thickness of 75 μm was superposed and pressed by a roll for lamination. Ultraviolet rays were radiated from the polyester film side to harden the lamination binder. Subsequently, the binder in the abrasive slurry was hardened by heating at 70° C. for 24 hours.

The resultant was cooled to room temperature and the mold sheet was removed. The binder in the abrasive layer was hardened by further heating at 100° C. for 24 hours. This abrasive material was stamped out into a circular shape having a diameter of 110 mm to fabricate an abrasive disk.

Figure 23:
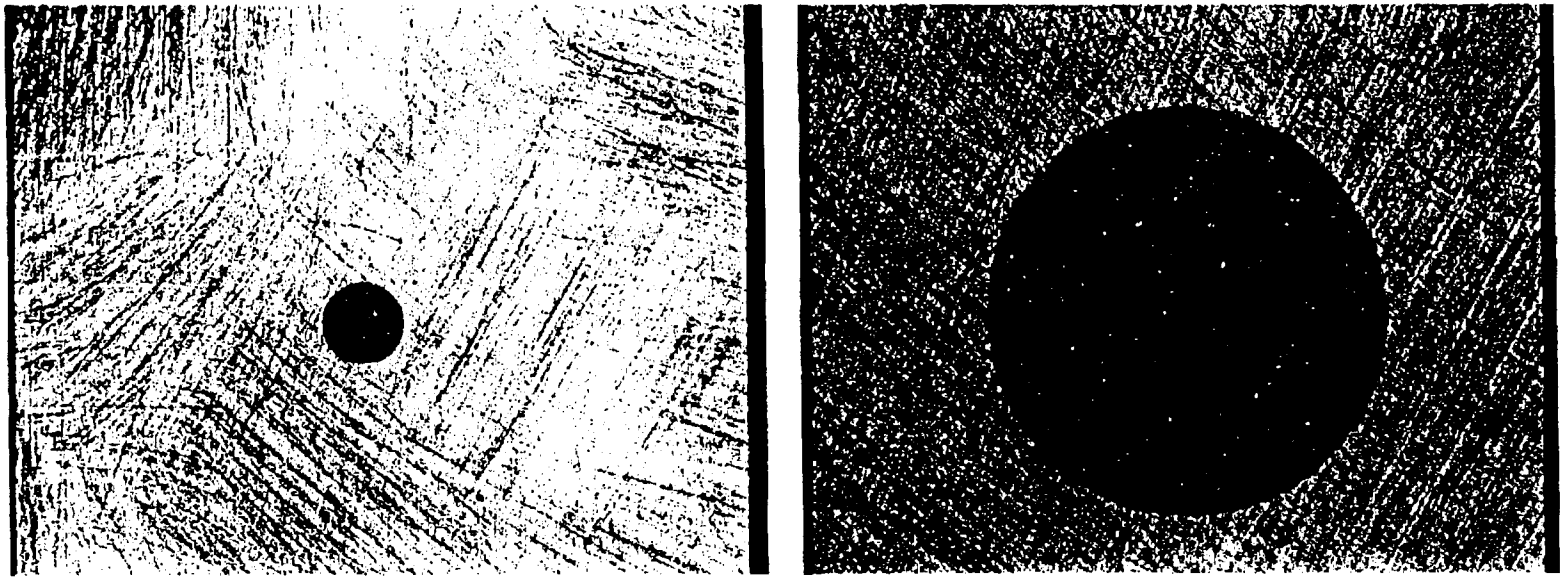
FIG. 23 is a microscope photograph of an end surface of an optical fiber connector after being abraded with the abrasive material of the present invention.

A circular rod of zirconia and an end surface of an optical fiber connector were abraded in the same manner as in Example 5 except that this abrasive disk was used. The change with time of the abraded amount of the circular rod of zirconia is shown in FIG. 16. The end surface of the optical fiber connector was observed by an electron microscope, whereby a smooth surface was confirmed. A microscope photograph is shown in FIG. 23.

Example 10

An abrasive material was fabricated in the same manner as in Example 9 except that the same mold sheet made of polypropylene as used in Example 6 was used. This abrasive material was stamped out into a circular shape having a diameter of 110 mm to fabricate an abrasive disk.

Figure 24:
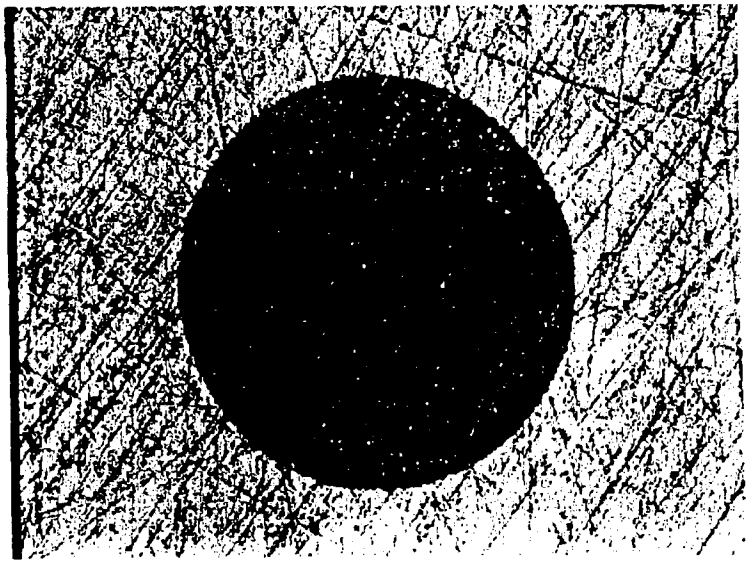
FIG. 24 is a microscope photograph of an end surface of an optical fiber connector after being abraded with the abrasive material of the present invention.
Figure 24:
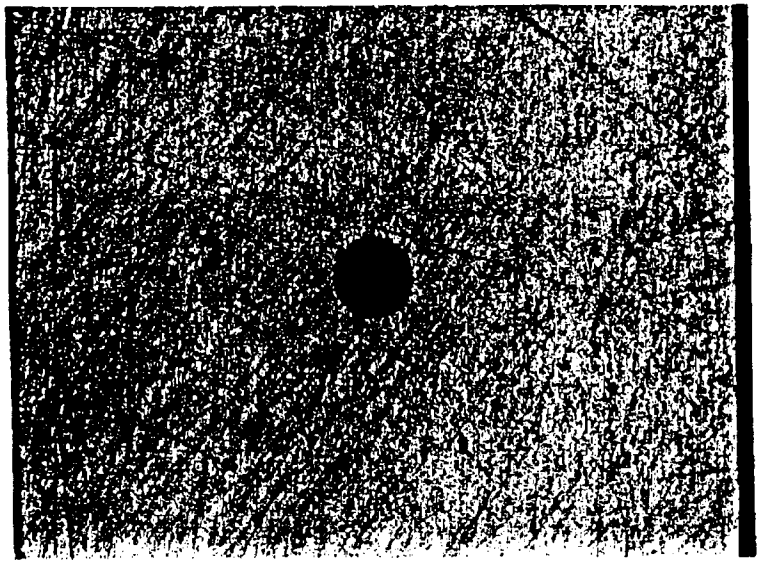

A circular rod of zirconia and an end surface of an optical fiber connector were abraded in the same manner as in Example 5 except that this abrasive disk was used. The change with time of the abraded amount of the circular rod of zirconia is shown in FIG. 16. The end surface of the optical fiber connector was observed by an electron microscope, whereby a smooth surface was confirmed. A microscope photograph is shown in FIG. 24.

Example 11

An abrasive material was fabricated in the same manner as in Example 9 except that a mold sheet made of polypropylene and having recesses with a shape of inverted three-dimensional elements shown in FIG. 3 was used. In this abrasive material, the abrasive layer has a three-dimensional structure of a pyramidal shape shown in FIG. 3 in which the top is truncated at a predetermined height. The dimensions are shown in Table 18.

TABLE 18

| Symbol | Dimension (μm) |
|---|---|
| h* | 175 μm |
| s* | 90 μm |
| o | 250 μm |
| u | 50 μm |
| y | 150 μm |
| α* | 30° |

The symbols h, s, and α represent the height of the three-dimensional element, the height of the top portion of the three-dimensional element, and the angle formed between two ridges of the three-dimensional element before the top is truncated, respectively.

Figure 25:
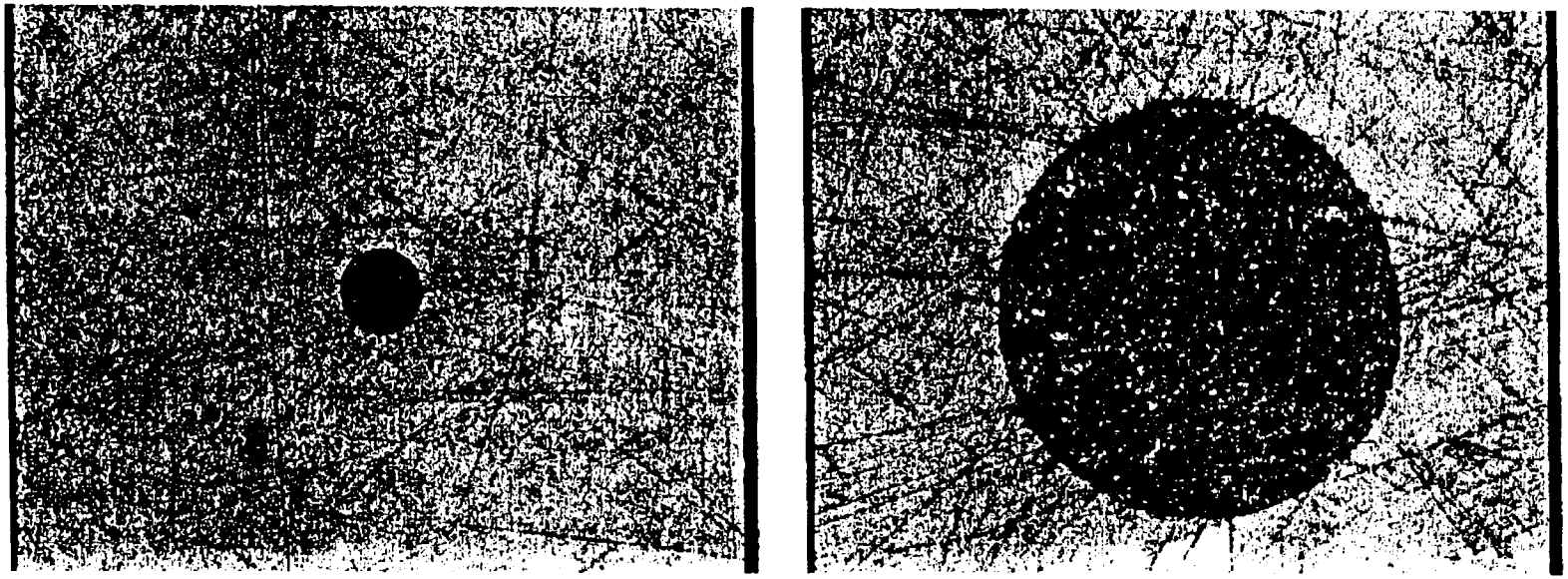
FIG. 25 is a microscope photograph of an end surface of an optical fiber connector after being abraded with the abrasive material of the present invention.

The obtained abrasive material was stamped out into a circular shape having a diameter of 110 mm to fabricate an abrasive disk. A circular rod of zirconia and an end surface of an optical fiber connector were abraded in the same manner as in Example 5 except that this abrasive disk was used. The change with time of the abraded amount of the circular rod of zirconia is shown in FIG. 16. The end surface of the optical fiber connector was observed by an electron microscope, whereby a smooth surface was confirmed. A microscope photograph is shown in FIG. 25.

From the graph shown in FIG. 16, it will be understood that the abrasive disks of Examples 5 to 11 exhibit a higher abrasive property and a longer product life than the abrasive disks of Comparative Examples 7 and 8. Also, by comparing FIGS. 17 to 20 and 23 to 25 with FIGS. 21 and 22, it will be understood that the abrasive disks of Examples 5 to 11 give a more smooth abraded surface than the abrasive disk of Comparative Example 7 which is a current product and the abrasive disk of Comparative Example 8 having an abrasive layer without a three-dimensional structure.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A method for producing an abrasive material having an abrasive layer of a three-dimensional structure, the method comprising the steps of:

(1) filling a mold sheet having a plurality of regularly arranged recesses with an abrasive material coating solution containing abrasive grains, a first binder, and a solvent, to a predetermined depth;

(2) removing the solvent from the abrasive material coating solution in the recesses by evaporation, (3) filling the recesses further with a second binder in the absence of abrasive particles;

(4) laminating a base material on the mold sheet to bond the binder to the base material; and (5) hardening the first and second binder.

2. The method according to claim 1, wherein said first and said second binder is hardened by ultraviolet radiation.

3. The method according to claim 1, wherein the tint binder contained in the abrasive material coating solution used in said stop (1) is selected from the group consisting of phenolic resin, aminoplast resin, urethane resin, epoxy resin, acrylate resin, acylated isocyanurate resin, urea-formaldehyde resin, isocyanurate resin, acrylated urethane resin, acrylated epoxy resin, resol-phenolic resin, polyester resin, vinyl resin, melamine resin and a mixture thereof.

4. The method according to claim 1, wherein the second binder used in said step (3) is selected from the group consisting of phenolic resin, aminoplast resin, urethane resin, epoxy resin, acrylate resin, acrylated isocyanurate resin, urea-formaldehyde resin, isocyanurate resin, acrylated urethane resin, acrylated epoxy resin, resol-phenolic resin, polyester resin, vinyl resin, melamine resin and a mixture thereof.

5. An abrasive material for abrading an end surface of an optical fiber connector into a predetermined shape, the abrasive material having a base material and an abrasive layer disposed on the base material, the abrasive layer having a three-dimensional structure constructed with a plurality of regularly arranged three-dimensional elements having a predetermined shape, the three dimensional elements having (1) a top layer comprising an abrasive composite comprising abrasive grains dispersed within a first binder and (2) a foot portion comprising a second binder in the absence of abrasive particles, wherein the three-dimensional elements have a height between about 2 micrometers and about 600 micrometers.

6. The abrasive material according to claim 5, wherein tops of said three-dimensional elements are constructed with points or lines parallel to a surface of the base material, and substantially all of said points or lines are located on a plane parallel to the surface of the base material.

7. The abrasive material according to claim 5, wherein the concentration of the abrasive grains in the top layer of said abrasive layer exceeds a critical pigment volume concentration.

8. The abrasive material according to claim 5, wherein the shape of said three-dimensional elements is a tetrahedral or pyramidal shape having ridges connected at a top.

9. The abrasive material according to claim 5, wherein the three-dimensional elements have a height between about 2 micrometers and about 300 micrometers.

10. The abrasive material according to claim 9, wherein the three-dimensional elements height varies less than 20%.

11. The abrasive material according to claim 5, wherein the shape of said three-dimensional elements is a prismatic shape having ridges parallel to a surface of the base material at a top.

12. The abrasive material according to claim 5, wherein the abrasive grains size is between about 0.01 and about 1 micrometer.

13. The abrasive material according to claim 5, wherein the abrasive grains size is between about 0.5 and about 20 micrometer.

14. The abrasive material according to claim 5, wherein the abrasive grains nominal size is between about 2 and about 4 micrometers.

15. The abrasive material according to claim 5, wherein the abrasive grains nominal size is between about 7 and about 10 micrometers.

16. The abrasive material according to claim 5, wherein the abrasive grains maximum size is about 16 micrometers.

17. The abrasive material according to claim 5, wherein the abrasive grains average size is between about 7.5 and about 9.5 micrometers.

18. The abrasive material according to claim 5, wherein said first binder is selected from the group consisting of phenolic resin, aminoplast resin, urethane resin, epoxy resin, acrylate resin, acrylated isocyanurate resin, urea-formaldehyde resin, isocyanurate resin, acrylated urethane resin, acrylated epoxy resin, resol-phenolic resin, polyester resin, vinyl resin, melamine resin and mixtures thereof.

19. The abrasive material according to claim 5, wherein said abrasive grains are selected from the group consisting of fused aluminum oxide, heat-treated aluminum oxide, silicon carbide, alumina zirconia, garnet, diamond, cubic boron nitride, silica, cerium oxide, sol-gel aluminum oxide, chromium oxide, zirconia, iron oxide and mixtures thereof.

20. The abrasive material according to claim 5, wherein said base material is flexible to be particularly suited for spherically abrading an end surface of an optical fiber connector.

21. The abrasive material according to claim 20, which is capable of providing an optical fiber connector end surface having a connection loss of not more than 1.0dB.

22. A method of polishing a workplace comprising:

providing a workpiece;

bringing the workpiece in contact with an abrasive article, the abrasive article comprising a base material and an abrasive layer disposed on the base material, the abrasive layer having a three-dimensional structure constructed with a plurality of regularly arranged three-dimensional elements having a predetermined shape, the three-dimensional elements having (1) a top layer comprising an abrasive composite comprising abrasive grains dispersed within a first binder and (2) a foot portion comprising a second binder in the absence of abrasive particles, wherein the three-dimensional elements have a height between about 2 micrometers and about 600 micrometers; and relatively moving the workpiece and the abrasive article.

23. The method of claim 22 wherein the workpiece is a fiber optic connector.

24. The method of claim 23 wherein the method provides an optical fiber connector end surface having a connection tons of not more than 1.0dB.

* * * * *

UNITED STATES PATENT AND TRADEMARK OFFICE

CERTIFICATE OF CORRECTION

PATENT NO. : 6,773,475 B2
DATED : August 10, 2004
INVENTOR(S) : Ohishi, Michihiro It is certified that error appears in the above-identified patent and that said Letters Patent is hereby corrected as shown below:

Column 3,
Line 11, after "(1)" insert -- a --.
Line 28, delete "bass" and insert -- base --, therefore.
Line 29, delete "shoot" and insert -- sheet --, therefore.

Column 5,
Line 65, delete "stakrts" and insert -- starts --, therefore.

Column 17,
Line 46, delete "k2/cm$^2$" and insert -- kg/cm$^2$ --, therefore.

Column 19,
Line 39, delete "10 mm" and insert -- , --, therefore.

Column 22,
Line 11, delete "tint" and insert -- first --, therefore.
Line 13, delete "stop" and insert -- step --, therefore.
Line 15, delete "acylated" and insert -- acrylated --, therefore.

Column 24,
Line 4, delete "workplace" and insert -- workpiece --, therefore.
Line 25, delete "tons" and insert -- loss --, therefore.

Signed and Sealed this

Twenty-fourth Day of May, 2005

JON W. DUDAS
*Director of the United States Patent and Trademark Office*